US010304294B2

(12) United States Patent
San

(10) Patent No.: US 10,304,294 B2
(45) Date of Patent: May 28, 2019

(54) GAMING MACHINE AND METHOD WITH SIC BO TYPE FEATURE

(71) Applicant: Ainsworth Game Technology Limited, Newington (AU)

(72) Inventor: Kin Wai San, Maroubra (AU)

(73) Assignee: Ainsworth Game Technology Limited, Newington, NSW (AU)

( * ) Notice: Subject to any disclaimer, the term of this patent is extended or adjusted under 35 U.S.C. 154(b) by 0 days.

(21) Appl. No.: 15/674,027

(22) Filed: Aug. 10, 2017

(65) Prior Publication Data

US 2019/0051119 A1 Feb. 14, 2019

(51) Int. Cl.
*G07F 17/34* (2006.01)
*G07F 17/32* (2006.01)

(52) U.S. Cl.
CPC ..... *G07F 17/34* (2013.01); *G07F 17/3211* (2013.01); *G07F 17/3246* (2013.01); *G07F 17/3258* (2013.01); *G07F 17/3286* (2013.01)

(58) Field of Classification Search
CPC ..... G07F 17/32; G07F 17/3244
See application file for complete search history.

(56) References Cited

U.S. PATENT DOCUMENTS 6,419,579 B1 7/2002 Bennett
7,922,575 B2 4/2011 Jankowski
9,710,995 B2 7/2017 Chun
2004/0166922 A1* 8/2004 Michaelson ..... A63F 13/12 463/20
2004/0166923 A1* 8/2004 Michaelson ..... G07F 17/32 463/20
2006/0202416 A1 9/2006 Madden et al.
2009/0181747 A1 7/2009 Nagano
2011/0105216 A1* 5/2011 Cohen ..... G07F 17/3244 463/20
2012/0142409 A1* 6/2012 Kelly ..... G07F 17/3244 463/25
2012/0289300 A1 11/2012 Chun

* cited by examiner

*Primary Examiner* — James S. McClellan
(74) *Attorney, Agent, or Firm* — Cook Alex Ltd.

(57) ABSTRACT

A gaming machine comprises a display and an electronic controller configured to display a first game and a second game comprising a first plurality of randomly generated numbers and a second plurality of randomly generated numbers, respectively. In the first game, a first combination of two or more of the randomly generated numbers is associated with triggering the second game. In the second game, a second combination of two or more of the randomly generated numbers is associated with a value award payable to a player, preferably a progressive jackpot prize. The second game may comprise a third combination associated with triggering a third game comprising a third plurality of randomly generated numbers where at least one combination is associated with another value award, preferably a progressive jackpot prize of higher value.

15 Claims, 13 Drawing Sheets

GAMING MACHINE AND METHOD WITH SIC BO TYPE FEATURE

BACKGROUND

The present disclosure relates to a gaming machine and method. The present disclosure has been developed primarily for use as an electronic gaming machine and will be described hereinafter by reference to this application. However, it will be appreciated that the present disclosure may also be implemented for any type of gaming machine, including a mechanical or electro-mechanical gaming machine.

The following discussion of the prior art is intended to present the present disclosure in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organised into three rows and five columns (a 5×3 array). Other arrays, such as a 3×3 or 4×3, may be used. Each gaming machine randomly selects the game symbols that appear on the array, each column of the array being a "reel".

One type of gaming machine comprises a mechanical or electro-mechanical device, where a motor rotates a plurality of annular rings or drums that form reels. Each reel has a reel strip that displays game symbols in preset game symbol positions. A frame covers the rings to provide a window through which only a subset of game symbol positions (and hence game symbols) were visible to the player. Thus, for a game using a 5×3 array, the window would only permit three rows of five rings to be visible to create the game array. An internal electronic controller within the gaming machine controls operation of the motor and hence rotation of the reels. Thus, by controlling when each reel starts and stops in its respective rotation, the electronic controller controls the display of the game symbols in the window. Sensors linked to the reels indicate which game symbols are displayed in the window and communicate with the electronic controller so that the electronic controller is able to award prizes based on winning combinations of game symbols displayed on the reels in the window. The electronic controller typically comprises one or more electric circuits for controlling various functions of the gaming machine, such as the above mentioned control of the motor, communicating with the sensors, verifying that the correct amount of a bet has been made via one or more value receiving mechanisms to enable operation of the motors, controlling any visual and/or audio effects associated with operation of the gaming machine and controlling operation of various alarms to alert any tampering with the gaming machine.

Another type of gaming machine, known as an electronic gaming machine or EGM, replaces the mechanical reels and motor with a video display screen on which video images of the reels are displayed. The EGM has an internal electronic game controller, typically a computer, that controls the display of images on the video display screen so that the reels are visibly spun on the screen to simulate a physical reel of a traditional gaming machine. EGMs tend to be more versatile in providing game information, varying the probabilities for a player to win a prize and varying the type of game that is played.

Bonus or "feature" games may also be provided by a gaming machine in addition to a base or main game. Typically feature games use the same set of reels as the main game and are limited to a set of free games operated under a single set of rules. This means that the feature game is restricted by the same set of rules, and so there is no variation in the play of the feature game. Also, gaming machines can offer one or more bonus prizes to the player during play of the game. The most common type of bonus prize that is awarded by the gaming machine is a jackpot prize, the main example of which is a progressive jackpot prize.

This standard structure to game play and bonus prizes limits the operation of the gaming machine, irrespective of whether it is a mechanical, electro-mechanical or electronic gaming machine. Consequently, it is difficult to retain player interest because there is no apparent incentive for the player to continue playing the gaming machine once the player becomes familiar with the feature game, the main game and any bonus prizes.

It is an object of the present disclosure to overcome or substantially ameliorate one or more of the disadvantages of prior art, or at least to provide a useful alternative.

SUMMARY

The present disclosure provides a gaming machine that has improved operation and performance relative to existing prior art gaming machines by providing a more efficient way of awarding prizes to a player of the gaming machine and in a more entertaining manner compared to presently existing gaming machines. The present disclosure also improves the application of an electronic controller in playing the game on the gaming machine.

One embodiment of the present disclosure provides a gaming machine comprising:

a display; and an electronic controller coupled to a display, the electronic controller being configured to:

display a first game on the display including a first plurality of randomly generated numbers, wherein a first combination of two or more of the randomly generated numbers is associated with triggering a second game; and display the second game including a second plurality of randomly generated numbers, wherein a second combination of two or more of the randomly generated numbers is associated with a value award payable to a player.

A further embodiment of the present disclosure provides a gaming machine comprising:

a display;

an electronic controller coupled to a display, the electronic controller being configured to:

display a first game on the display including a first plurality of randomly generated numbers, wherein a first combination of two or more of the randomly generated numbers is associated with triggering a second game; and display the second game including a second plurality of randomly generated numbers, wherein a second combination of two or more of the randomly generated numbers is associated with a value award payable to a player; and a value transfer mechanism for receiving value from the player, wherein the electronic controller communicates with the value transfer mechanism such that when a threshold amount of value has been received from the value transfer mechanism, the electronic controller initiates a play of the first game.

Yet another embodiment of the present disclosure provides a gaming machine comprising:

at least one display;

a value input comprising at least one of a coin acceptor, a bill acceptor and a ticket reader; and at least one electronic controller coupled to the at least one display and the value input, the at least one controller configured:

to determine if a wager has been received via the value input;

to display a first game on the display including a first plurality of randomly generated numbers, wherein a first combination of two or more of the randomly generated numbers is associated triggering a second game:

to display the second game on the display including a second plurality of randomly generated numbers, wherein a second combination of two or more of the randomly generated numbers is associated with a value award payable to a player.

An additional embodiment of the present disclosure provides a gaming machine comprising:

a display; and an electronic controller coupled to a display, the electronic controller being configured to:

display a first game on the display including a first plurality of randomly generated numbers shown on the display represented by dice symbols, wherein a first combination of two or more of the randomly generated numbers is associated with triggering a second game;

display the second game including a second plurality of randomly generated numbers shown on the display represented by dice symbols, wherein a second combination of two or more of the randomly generated numbers is associated with a first value award payable to a player and a third combination of two or more of the randomly generated numbers is associated with triggering a third game; and display the third game comprising a third plurality of randomly generated numbers shown on the display represented by dice symbols, wherein the third game comprises at least one combination of two or more of the randomly generated numbers associated with a second value award payable to a player.

An additional embodiment of the present disclosure provides a gaming machine comprising:

a display; and an electronic controller coupled to a display, the electronic controller being configured to:

display a first game on the display including a first plurality of randomly generated numbers, wherein a first combination of two or more of the randomly generated numbers is associated with a game enhancing element awardable to a player, display a second game including one or more configurations of game symbols, one or more of the configurations of game symbols being associated with a winning game outcome, the winning game outcome being associated with a value award payable to the player; and modify an outcome of the second game by applying the game enhancing element.

An additional embodiment of the present disclosure provides a method comprising:

displaying first game on the display including a first plurality of randomly generated numbers;

associating a first combination of two or more of the randomly generated numbers with triggering a second game;

displaying the second game including a second plurality of randomly generated numbers; and associating a second combination of two or more of the randomly generated numbers with a value award payable to a player.

A yet further embodiment provides a method comprising:

receiving value via a value transfer mechanism;

determining whether the received value meets a threshold amount;

initiating a play of a first game if the received value is equal to or greater than the threshold amount;

displaying the first game on the display including a first plurality of randomly generated numbers;

associating a first combination of two or more of the randomly generated numbers with triggering a second game;

displaying the second game on the display including a second plurality of randomly generated numbers; and associating a second combination of two or more of the randomly generated numbers with a value award payable to a player.

Yet another embodiment provides a method comprising:

determining if a wager has been received via a value input comprising at least one of a coin acceptor, a bill acceptor and a ticket reader;

displaying display a first game on the display including a first plurality of randomly generated numbers;

associating a first combination of two or more of the randomly generated numbers with triggering a second game;

displaying the second game on the display including a second plurality of randomly generated numbers; and associating a second combination of two or more of the randomly generated numbers with a value award payable to a player.

A further embodiment provides a computer system comprising a central processing unit configured for communication with a gaming machine, wherein the computer system is configured to perform the method of any one of the above described embodiments of the present disclosure.

A further embodiment provides a computer program configured to perform the method of any one of the above described embodiments of the present disclosure.

A further embodiment provides a non-transitory carrier medium carrying computer executable code that, when executed on a central processing unit configured for communication with a gaming machine, causes the central processing unit to perform the method of any one of the above described embodiments of the present disclosure.

Throughout the specification and unless explicitly stated otherwise, the term "value" means credits, gaming tokens, coins, paper, currency, tickets, vouchers, credit cards, debit cards, smart cards, memory devices capable of storing value and any other object representative of value.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Furthermore, as used herein and unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

BRIEF DESCRIPTION OF THE DRAWINGS

The disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings is necessarily to scale.

DETAILED DESCRIPTION OF VARIOUS EMBODIMENTS

Figure 1:
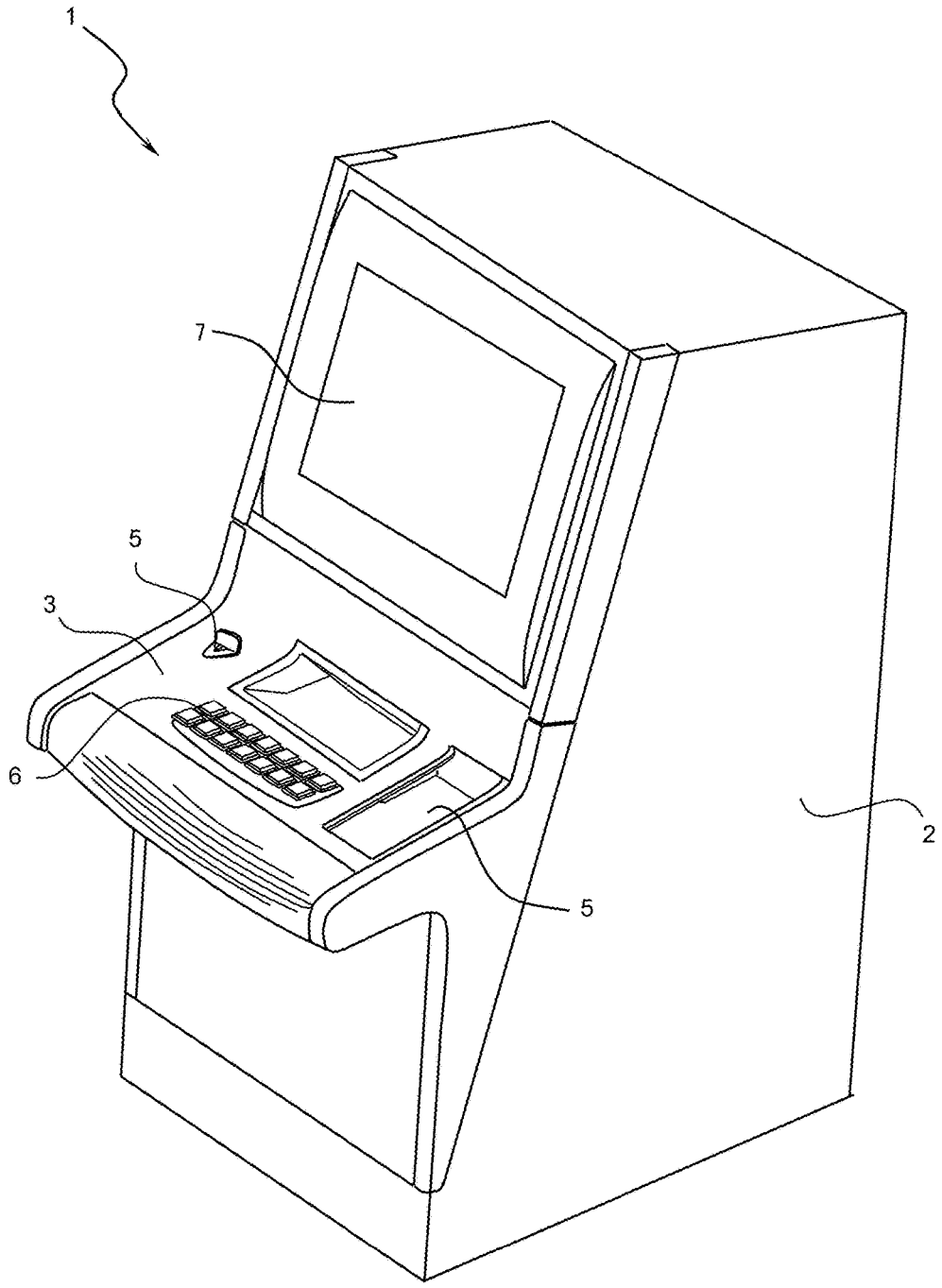
FIG. 1 is a perspective view of a gaming machine according to a first embodiment of the present disclosure.

The present disclosure will now be described with reference to the following examples which should be considered in all respects as illustrative and non-restrictive. In the Figures, corresponding features within the same embodiment or common to different embodiments have been given the same reference numerals.

In general terms, a gaming machine according to the embodiments described herein includes at least one display, and an electronic controller coupled to the at least one display. In some embodiments, the gaming machine comprises a value transfer mechanism or a value input that is coupled to the electronic controller.

The electronic controller, in one embodiment, is configured to display a first game on the display including a first plurality of randomly generated numbers, wherein a first combination of two or more of the randomly generated numbers is associated with triggering a second game. The electronic controller is also configured to display the second game on the display including a second plurality of randomly generated numbers, wherein a second combination of two or more of the randomly generated numbers is associated with a value award payable to a player.

In another embodiment, the electronic controller is configured to display a first game on the display including a first plurality of randomly generated numbers shown on the display represented by dice symbols, wherein a first combination of two or more of the randomly generated numbers is associated with triggering a second game. The electronic controller is also configured to display the second game on the display including a second plurality of randomly generated numbers shown on the display represented by dice symbols, wherein a second combination of two or more of the randomly generated numbers is associated with a first value award payable to a player and a third combination of two or more of the randomly generated numbers is associated with triggering a third game. The electronic controller is further configured to display the third game comprising a third plurality of randomly generated numbers shown on the display represented by dice symbols, wherein the third game comprises at least one combination of two or more of the randomly generated numbers associated with a second value award payable to a player.

In a further embodiment, the electronic controller is configured to display a first game on the display including a first plurality of randomly generated numbers, wherein a first combination of two or more of the randomly generated numbers is associated with a game enhancing element awardable to a player. The electronic controller is also configured to display a second game including one or more configurations of game symbols, one or more of the configurations of game symbols being associated with a winning game outcome, the winning game outcome being associated with a value award payable to the player. The electronic controller is further configured to modify an outcome of the second game by applying the game enhancing element.

In some embodiments, the second game is displayed in response to the second combination appearing in the first game.

In some embodiments, more than one combination of two or more of the randomly generated numbers in the first game is associated with triggering the second game.

In some embodiments, more than one combination of two or more of the randomly generated numbers in the second game is associated with the value award.

In some embodiments, the second game comprises a plurality of value awards, the value awards having differing amounts of value, and at least one combination of two or more of the randomly generated numbers is associated with each value award. In other embodiments, more than one combination of two or more of the randomly generated numbers in the second game is associated with at least one value award. In further embodiments, each value award is associated with more than one combination of two or more of the randomly generated numbers in the second game.

In some embodiments, the second game comprises a third combination of two or more of the randomly generated numbers associated with triggering a third game. In other embodiments, the third game comprises a third plurality of randomly generated numbers. In one embodiment, the third game is displayed on the display in response to the third combination appearing in the second game.

In some embodiments, the second game comprises a plurality of value awards and the third combination is associated with at least one of the value awards.

In some embodiments, wherein the third game comprises at least one combination of two or more of the randomly generated numbers associated with a value award payable to a player. In other embodiments, more than one combination of two or more of the randomly generated numbers in the third game is associated with the value award.

In some embodiments, the third game comprises a plurality of value awards, the value awards having differing amounts of value, and at least one combination of two or more of the randomly generated numbers is associated with each value award. In other embodiments, more than one combination of two or more of the randomly generated numbers in the third game is associated with at least one value award. In further embodiments, each value award is associated with more than one combination of two or more of the randomly generated numbers in the third game.

In some embodiments, the first game comprises at least one combination of two or more of the randomly generated numbers associated with a value award payable to a player. In other embodiments, the first value award of the first game comprises a credit prize. In another embodiment, the first value award comprises a first jackpot prize.

In some embodiments, the value award in the second game comprises a jackpot prize, preferably a progressive jackpot prize. In other embodiments, the value award in the third game comprises a jackpot prize, preferably a progressive jackpot prize. In further embodiments where there is a plurality of value awards in the second and third games having differing amounts of value, one or more of the value awards are jackpot prizes, preferably progressive jackpot prizes.

In some embodiments the first jackpot prize, the second jackpot prize, the third jackpot prize, the fourth jackpot prize, the fifth jackpot prize or any combination thereof are progressive jackpot prizes. In other embodiments, the progressive jackpot prizes are standalone progressive jackpot prizes. In further embodiments, the progressive jackpot prizes are linked progressive jackpot prizes.

In some embodiments, there is a plurality of value awards in the first game, second game, third game or any combination thereof, the value awards having differing amounts of value. In one embodiment, different types of value awards are associated with different combinations of randomly generated numbers in the first game, second game, third game or any combination thereof.

In some embodiments, the electronic controller is configured to display the first plurality of randomly generated numbers on the display. In some embodiments, the electronic controller is configured to display the second plurality of randomly generated numbers on the display. In some embodiments, the electronic controller is configured to display the third plurality of randomly generated numbers on the display.

In some embodiments, the randomly generated numbers are generated sequentially. In some embodiments, the first plurality of randomly generated numbers is generated sequentially. In some embodiments, the second plurality of randomly generated numbers is generated sequentially. In some embodiments, the third plurality of randomly generated numbers is generated sequentially.

In some embodiments, the first game comprises two or more plays of the first game. In other embodiments, each play of the first game comprises generating one of the first plurality of randomly generated numbers.

In some embodiments, the second game comprises two or more plays of the second game. In other embodiments, each play of the second game comprises generating one of the second plurality of randomly generated numbers.

In some embodiments, the third game comprises two or more plays of the third game. In other embodiments, each play of the third game comprises generating one of the third plurality of randomly generated numbers.

In some embodiments, the first plurality of randomly generated numbers, the second plurality of randomly generated numbers, the third plurality of randomly generated numbers or any combination thereof are randomly generated from a predefined range of numbers. In one embodiment, the predefined range of numbers is from 1 to 6. In another embodiment, the predefined range of numbers is 1 to 75. In a further embodiment, the predefined range of numbers is 1 to 80. In yet another embodiment, the predefined range of numbers is 1 to 90.

In some embodiments, the second game is an enhanced version of the first game. In one embodiment, the second game may offer prizes of higher worth and/or increased probabilities to win the value award(s) compared to the first game. In other embodiments, the third game is an enhanced version of the second game. In one embodiment, the third game may offer prizes of higher worth and/or increased probabilities to win the value award(s) compared to the second game.

In some embodiments, the first plurality of randomly generated numbers, the second plurality of randomly generated numbers, the third plurality of randomly generated numbers or any combination thereof are displayed on the display by Arabic numerals. In other embodiments, the first plurality of randomly generated numbers, the second plurality of randomly generated numbers, the third plurality of randomly generated numbers or any combination thereof are displayed on the display by Chinese numerals. In one embodiment, the first plurality of randomly generated numbers, the second plurality of randomly generated numbers, the third plurality of randomly generated numbers or any combination thereof are displayed on the display by dice symbols.

In some embodiments, the first game comprises a Sic Bo type game. In some embodiments, the second game comprises a Sic Bo type game. In some embodiments, the third game comprises a Sic Bo type game. In further embodiments, any combination of the first, second and third games comprise Sic Bo type games.

In some embodiments, the first game comprises a Bingo type game. In some embodiments, the second game comprises a Bingo type game. In some embodiments, the third game comprises a Bingo type game. In further embodiments, any combination of the first, second and third games comprise Bingo type games.

In some embodiments, the first game comprises a Keno type game. In some embodiments, the second game comprises a Keno type game. In some embodiments, the third game comprises a Keno type game. In further embodiments, any combination of the first, second and third games comprise Keno type games.

Referring to FIG. 1, a gaming machine 1 according to a first embodiment includes a cabinet 2, a console 3 and an internal electronic controller 4. The console 3 has various input devices including value inputs, such as vending slots 5 for receiving monetary bets, and a plurality of buttons 6 for actuation by a player. It will be appreciated that in other embodiments the vending slots 5 may be replaced with other types of value input/value output devices, such as a coin acceptor, a paper currency acceptor, a ticket reader and/or printer or a card reader and/or writer.

The vending slots 5 can be configured to receive value, such as cash in the form of banknotes and coins, or credits representing a monetary amount from a memory device, such as but not limited to a memory card, smart card, a radio frequency identification (RFID) device, USB key, magnetic card or other electronic storage device. Typically, the memory device is a credit card, debit card or other card that enables the transfer of monetary credit to the gaming machine 1. Other forms of value include gaming tokens, paper, tickets, vouchers, and any other object representative of value.

Figure 2:
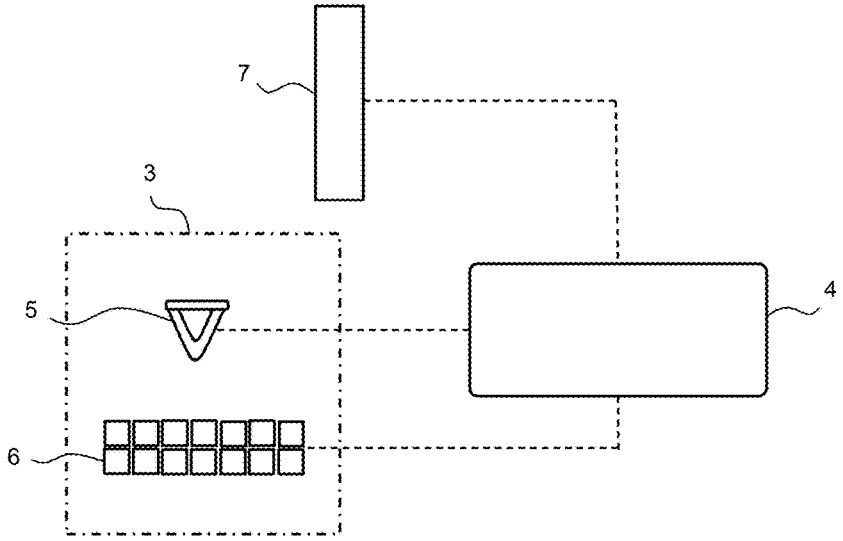
FIG. 2 is a schematic drawing of an electronic controller for the gaming machine of FIG. 1.

The electronic controller 4 is generally in the form of an electronic game controller comprising a central processing unit, such as a computer, and is in electronic communication with a display in the form of a video display screen 7, as well as various input devices on the console 3, as best shown in FIG. 2. Typically, the electronic game controller 4 also comprises a random access memory (RAM) associated with the central processing unit, the RAM being used to store programme instructions and transient data related to the operation of the electronic game controller and hence the gaming machine 1. The RAM contains a body of program instructions for implementing a game on the gaming machine 1, as discussed in more detail below. The central processing unit or processor may also be operatively associated with a further storage device, such as a hard disk drive, which is used for long-term storage of program components and data relating to the electronic game controller 4 and/or the gaming machine 1, including a database for game performance data, as well as information gathered from users. It is also appreciated that a person skilled in the art would readily understand the location and use of the electronic game controller 4 in the gaming machine 1.

The electronic game controller 4 will transmit and receive signals to and from each of the input devices and the display 7, usually via wired connections but can include wireless modes of electronic communication, such as WLAN. In the case of the vending slots 5 (or with any other type of value transfer mechanism), there may be an intermediate credit verification device that examines and verifies the cash or credits received by the vending slots. Once the value (such as cash or credits) have been verified by the credit verification device, a signal is sent to the electronic game controller 4, which then determines whether the minimum bet level has been reached. If so, the electronic game controller 4 will permits play of the game on the gaming machine 1. If not, the electronic game controller 4 will send a signal to the display 7 to show a message requesting further value to be added to the gaming machine 1.

Figure 3:
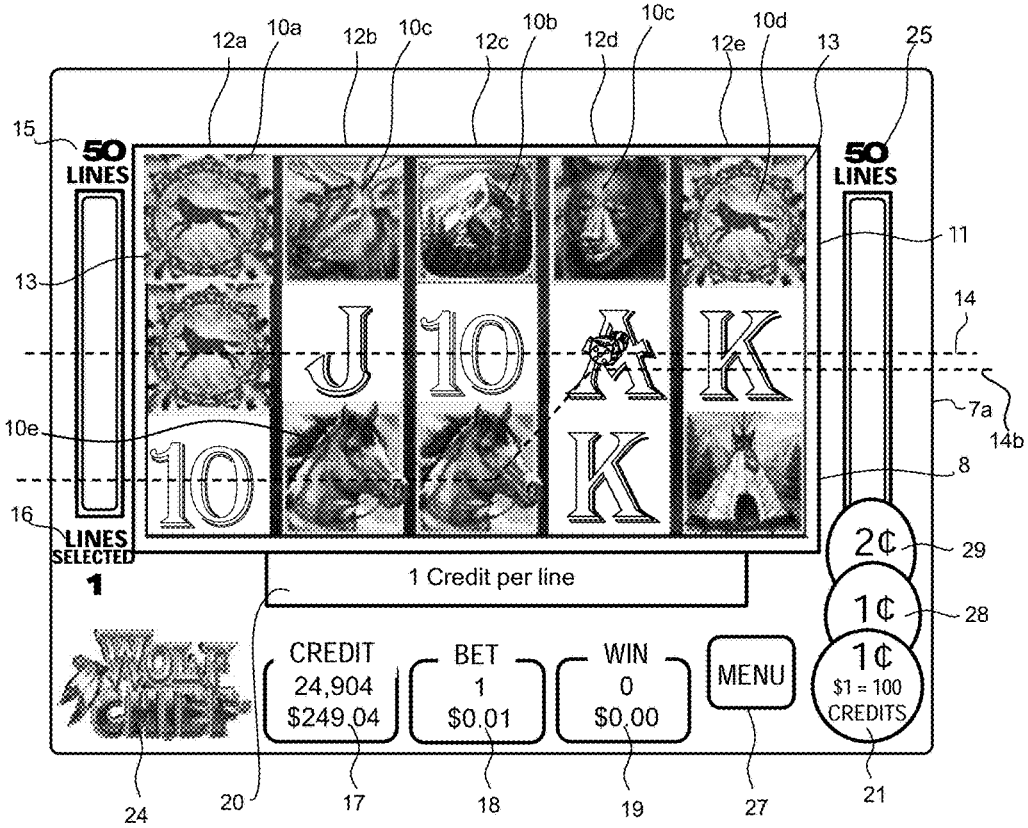
FIG. 3 is a simulated screen shot of a base game shown on the display of the gaming machine of FIG. 1.
Figure 4:
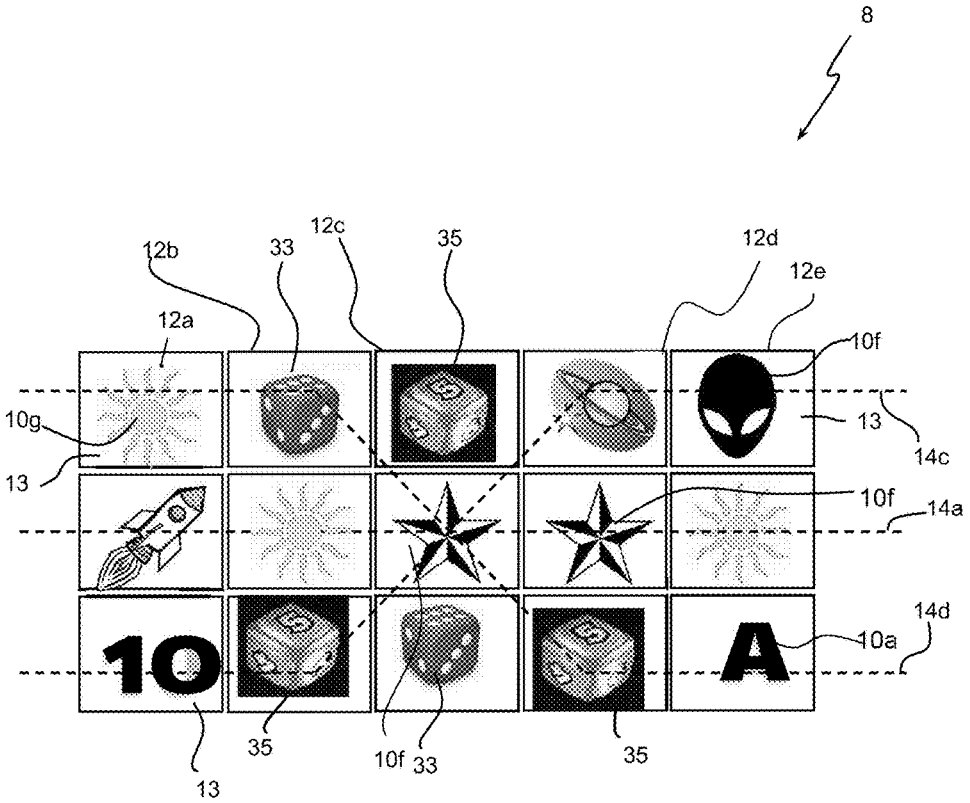
FIGS. 4 and 5 are simulated screen shots of a feature game shown on the display of the gaming machine of FIG. 1.
Figure 5:
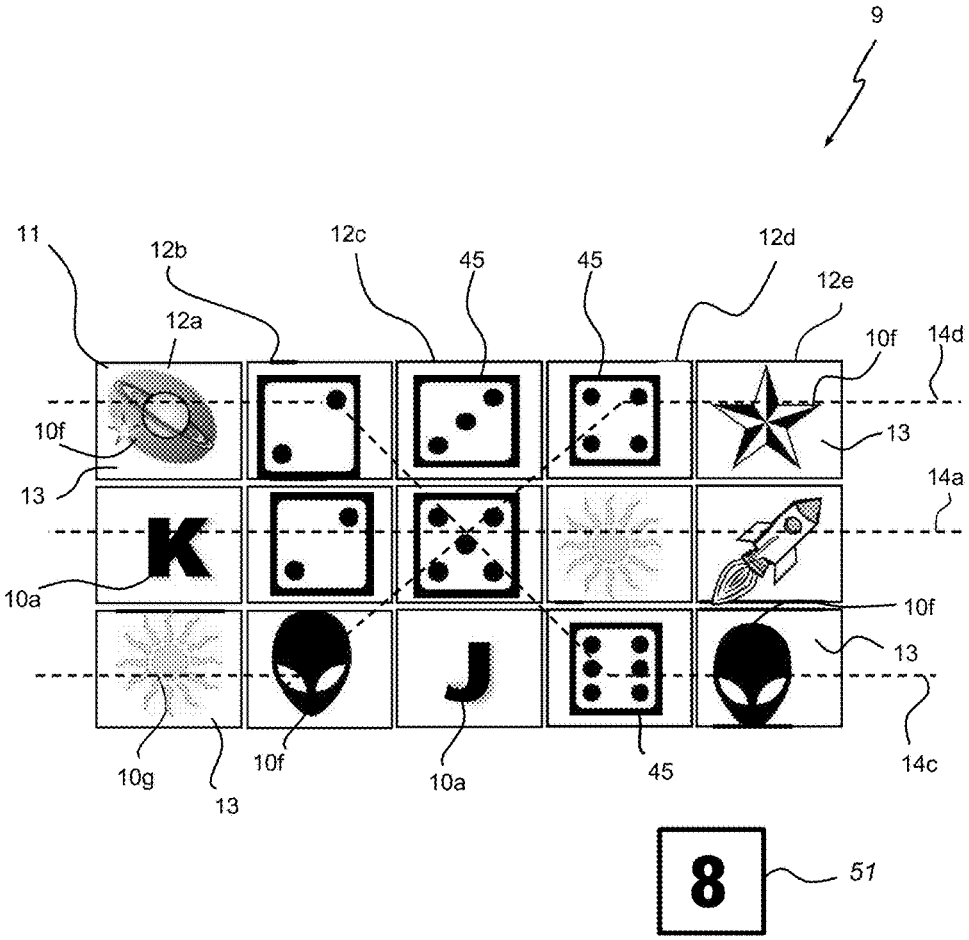

The electronic game controller 4 is programmed to provide a game in the form of a base game 8 (as best shown in FIGS. 3 and 4) and a feature game 9 (as best shown in FIGS. 4 and 5) on a lower playing area 7*a* of the display 7 of the gaming machine 1 for play by a player. An upper display area is reserved for showing artwork associated with the game(s) that are available for play on the gaming machine and/or other game information. The base game 8 has game symbols 10 arranged into an array 11 in the form of five columns or "reels" 12. The reels 12 give the visual appearance of rotating, typically by having the game symbols 10 move in a downward linear path along the length of each reel 12. While the array 11 is arranged with five reels 12 and three rows as per the industry standard, it will be appreciated by one skilled in the art that other types of arrays could be used, such as 3×3, 4×3, 5×5, 4×4, etc, including arrays having an irregular number of rows and/or columns. For example, the array 11 can have an unequal number of rows and/or columns, where some columns have less or more rows than other columns or where some rows have less or more columns than other rows. A more specific example would be an array having three columns with only two rows and two columns with three rows. The electronic game controller 4 will transmit signals to the display screen 7 to cause the base game 8 and feature game 9 to be played on the lower playing area 7*a*, including showing the game symbols 10, array 11 and other visible elements of the games.

The array 11 of the base game 8 defines predetermined game or symbol positions 13, in which the game symbols 10 appear. The symbol positions 13 are not visually marked by boundary lines and simply provide an area for the game symbols 10 to appear. However, it will be appreciated that in other embodiments, the symbol positions 13 are defined by visible boundary lines (to define "squares" or game positions) or other markings to define each respective area of the symbol positions.

The array 11 is arranged so that a player can select one or more predetermined "pay lines" 14 defined around the array, which correspond to combinations of the symbol or game positions 13. The pay lines 14 correspond to the lines selected by the player and generally comprise at least one game position or symbol position 13 from each reel 12. The number of pay lines 14 that can be selected by the player depends on the amount of the monetary bet for playing a game on the array 11. In the base game 8, predetermined winning combinations of randomly selected game symbols 10 result in the award of prizes to the player.

The game symbols 10 can include a mixture of picture symbols (such as animal symbols or playing card symbols), word symbols, scatter symbols, substitute or wild card symbols and trigger symbols to trigger the feature game 9. Those skilled in the art will readily understand that a substitute symbol is able to act as any other game symbol, and hence is also known as a "wild card" symbol. Likewise, those skilled in the art will readily understand that a scatter symbol is a symbol that triggers a game event or confers an award without having to appear on a player-selected pay line 14. Similarly, a trigger symbol is a symbol that triggers a game event or confers an award, where the trigger symbol may or may not have to appear in combination and may or may not have to appear on the same player-selected pay line 14. In a typical game shown in FIG. 3, the game symbols 10 include playing card symbols 10*a*, animal-themed symbols 10*b*, item-themed symbols 10*c*, scatter symbols in the form of "wolf banner" symbols 10*d* and a substitute or wild card symbol in the form of horse symbols 10*e*. In one embodiment shown in FIG. 4, the game symbols 10 generally involve a space theme so that the game symbols 10 include space-themed picture symbols 10*f* and scatter Sun symbol 10*g*. The electronic game controller 4 randomly determines the appearance of the game symbols 10 on the array 11.

The video screen 7 also displays other standard game information in the lower playing area 7*a*, including the number of pay lines available 15, the number of player-selected pay lines 16, the amount of player credits 17, the amount of the current bet wagered by the player 18, the amount of wins by the player 19, a message area 20, a current denomination button 21 indicating the currently selected base bet denomination and the name 24 of the base game 8, Wolf Chief™, as best shown in FIG. 3. In other embodiments, the video screen 7 displays a menu button for bringing up a menu screen (typically explaining the game rules and showing the available pay lines 14) and/or jackpot information relating to the based game 8 and feature game 9 that are awarded by the electronic gaming machine 1. This jackpot information is typically displayed in the upper display area and can comprise, in descending order of monetary value, a grand jackpot, major jackpot, minor jackpot and midi jackpot.

In the base game 8, the player initially makes a bet using vending slots 5 to initiate play of the gaming machine 1 by building up credit to play the base game 8 on the gaming machine. For example, the player can bet or wager monetary amounts equivalent to a particular amount of credits, depending on the bet denomination selected for the base game. Also, the player can make any additional side bets or ante-bets during play of the base game 8 once the base game has commenced to access additional features in the base game, such as increasing the number of winning combinations in the base game.

Typically, gaming machines offer a number of preset bet options that the player can make, and these bet options can vary depending on the game or games offered on the gaming machine. For example, a game on a gaming machine may provide bet options of 1 credit, 2 credits, 5 credits and 10 credits per player-selected pay line 14. In another example, the player may bet 1 credit, 2 credits, 5 credits and 10 credits for a preset group or combination of pay lines 14, such as a group of 5 pay lines, 10 pay lines, 20 pay lines, etc.

The gaming machine 1 also has a default bet denomination, which is usually the bet denomination that was previously used in the preceding play of the base game 8. For example, if a person had played the base game 8 with a bet denomination of 5¢, then this would be the default bet denomination for the player when he or she commences play of the game. Where the gaming machine has not yet been played or has been started up, the default bet denomination is initially selected by the electronic game controller 4. The default bet denomination can be randomly selected or chosen according to a predetermined order. Usually, the electronic game controller 4 will select the bet denomination with the lowest value that is available for the base game 8, which would be the 1¢ bet denomination for this embodiment. The player may change the bet denomination at any time in the base game 8 by touching the denomination button 21 before or after the reels 12 have spun. In this embodiment, touching the denomination button will bring denomination images 28, 29 that the player may select to quickly change the bet denomination between plays of the game 8.

Once the player has commenced play of the game 8 by making an appropriate bet via the vending slots 5, the electronic game controller 4 then commences a play of the base game 8 by sending a signal to the display 7 to cause the reels 12 to appear to visibly rotate or "spin" in a linear path, typically in a downward vertical direction, and randomly display the game symbols 10 in each game position for each play of the array 11 for the base game 8. After the reels 12 stop spinning (and thus ends the spin or play of the base game 8), the electronic game controller 4 determines whether there are any predetermined winning combinations of the game symbols 10 appearing in any player-selected pay lines 14, such as a two of a kind, three of a kind, four of a kind or five of a kind for all the game symbols 10 and other combinations of a "full house", "straight" or "flush" for the playing card game symbols 10*a*. It will be appreciated that other winning combinations of game symbols 10 can also be provided. If so, the gaming machine 1 enters a winning game state and awards a prize according to the displayed predetermined winning combination.

In the embodiment of FIG. 4, two types of substitute symbols may appear in the base game, a "red" die symbol 33 and "gold" die symbol 35. Both the red die symbol 33 and gold die symbols 35 are shown in a three-dimensional representation. The gold die symbol 35 acts as a trigger symbol for a jackpot feature game 40 discussed in more detail below.

The electronic game controller 4 also determines whether the feature game 9 should be activated, based on a predetermined feature game trigger event, such as the appearance of a number of trigger symbols appearing in a play or spin of the base game 8. In this embodiment, the feature game trigger event is the appearance of three scatter Sun symbols 10*g*, as best shown in FIG. 4. The scatter symbols 10*g* need not appear on the same pay line 14, but can appear on any of the player-selected pay lines.

In response to the trigger event, the electronic game controller 4 then transmits a signal to the video screen 7 to cause the feature game 9 to appear on the video screen 7, as best shown in FIG. 5. In this embodiment, the feature game 9 uses the same game symbols 10 as the base game 8, as well as the same array 11, reels 12*a* to 12*e*, game positions 13 and player-selectable pay lines 14 on the video screen 7. In this embodiment, the Sun symbol 10*g* only appears on reels 12*a* and 12*e* (corresponding to reels 1 and 5, as these reels are usually known in the art). Special die symbols 45 may also appear in any of reels 12*b* to 12*d* (corresponding to reels 2, 3 and 4), the die symbols 45 being a two-dimensional form of the red "standard" die symbols 33.

In the feature game 9, eight free plays or spins of the feature game are awarded to the player without having to make an additional bet or wager. It will be understood by those skilled in the art that a free play or spin involves a play of the game without requiring any bet to be made by the player, and that any number of free spins can be chosen for the feature game 9. In addition, it will be appreciated that in the art free spins are commonly referred to as "free games". The number of free games remaining in the feature game 9 is indicated by a counter 50.

The feature game 9 operates in a similar manner to the base game 8, where the reels 12 visibly rotate and display randomly selected game symbols 10 in each game position 13, as best shown in FIG. 4. Predetermined winning combinations of randomly selected game symbols 10 in the array 11 of the feature game 9 also result in the award of prizes to the player, usually of an enhanced value compared to the prizes awarded in the base game 8. The predetermined winning combinations of symbols in the feature game 9 may be the same as or similar to the winning combinations of symbols in the base game 8. Whenever three or more Sun symbols 10*g* appear on the array in reels 12*a* and 12*e*, three additional free games of the feature game 9 are awarded to the player.

Whenever die symbols 45 appear in the game positions 13 of the array 11 in the feature game 9, they act as substitute or wild card symbols to enhance the probability of obtaining one of the predetermined winning combinations of symbols. In addition, each die symbol 45 displays one of the six possible amounts for a die; one, two, three, four, five and six. These amounts displayed on the die symbols 45 confer a multiplier equivalent to the displayed amount where the die symbol forms part of a winning combination. In other words, the die symbols 45 are effectively wild card multiplier symbols, where the multiplier is indicated by the amount shown on each die symbol. In addition, where more than one die symbol 45 appears on the same payline 14, then the multipliers "stack" and add up to provide a higher multiplier amount. For example, in FIG. 4, payline 14*a* has a two die symbol and a five die symbol, which would confer a multiplier of ×7 (2+5) to the prize awarded for a winning combination appearing on that payline (such as, three of a kind of the rocket symbol formed by one rocket symbol and two die symbols 40). Similarly, payline 14*c* has a two die symbol, a five die symbol and a six die symbol which would confer a multiplier of ×13 (2+5+6) to the prize awarded for a winning combination appearing on that payline (four of a kind of the planet or alien symbol formed by one planet or alien symbol and the three die symbols 40). Payline 14*d* has a four and a five die symbols 45, which would confer a multiplier of ×9 (4+5) to the prize awarded for a winning combination appearing on that payline, being a three of a kind of the star or alien symbol formed by one star or alien symbol and the two die symbols 45. Once the number of free games are exhausted in the feature game 9, the electronic game controller 4 sends a signal to the video display screen 7 to show the base game 8.

Referring back to FIG. 4, after a spin or play of the base game 8, the electronic game controller 4 determines whether the jackpot feature game 40 should be activated at the same time as determining whether to activate the feature game 9. Where both the feature game 9 and jackpot feature game 40 are both activated in the same play or spin of the reels 12, then the feature game 9 is initially played and then the jackpot feature game 40 is played. However, this order of play may be reversed. In this embodiment, and as stated above, the jackpot feature game 40 is triggered by three gold die symbols 35 appearing in any game position 13 of reels 12*b*, 12*c* and 12*d*, as best shown in FIG. 4.

Figure 6:
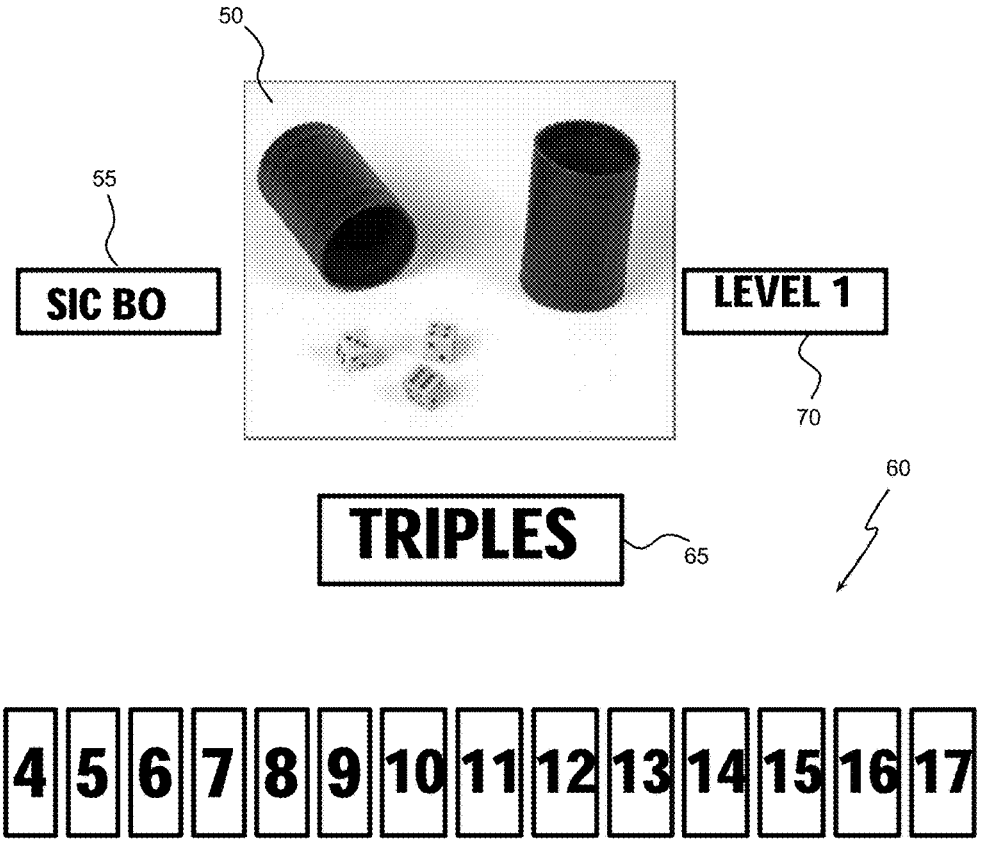
FIGS. 6 to 9 are partial simulated screen shots of a jackpot feature game shown on the display of the gaming machine of FIG. 1.

In response to the trigger event, the electronic game controller 4 then transmits a signal to the video screen 7 to cause the feature game 9 to appear on the video screen 7, as best shown in FIGS. 6 to 10. The jackpot feature game 40 is played in the style of the well known game of Sic Bo, which involves the rolling of three dice and monetary prizes being awarded based on the number calculated from the amounts shown on the dice and/or combinations of the amounts shown on the dice. In this embodiment, a modified form of Sic Bo is played, where only the number calculated from the amounts of the dice are used and a "triple" (i.e. three of a kind) are used. Referring to FIG. 6, the jackpot feature game 40 comprises an image 50 showing a dice cup and three dice (which may be animated) and a banner 55 stating a Sic Bo type game is being played. A mat 60 shows all but two of the possible number combinations for three six-sided dice, from 4 to 17, while there is an image 65 for triple combinations that would include the totals 3 (three ones) and 18 (three sixes) omitted from the mat. It will be appreciated that triples also include the combinations of three twos (adding up to six), three threes (adding up to nine) three fours (adding up to twelve) and three fives (adding up to fifteen). A banner 70 indicates the current "level" of the jackpot feature game 40.

Figure 7:
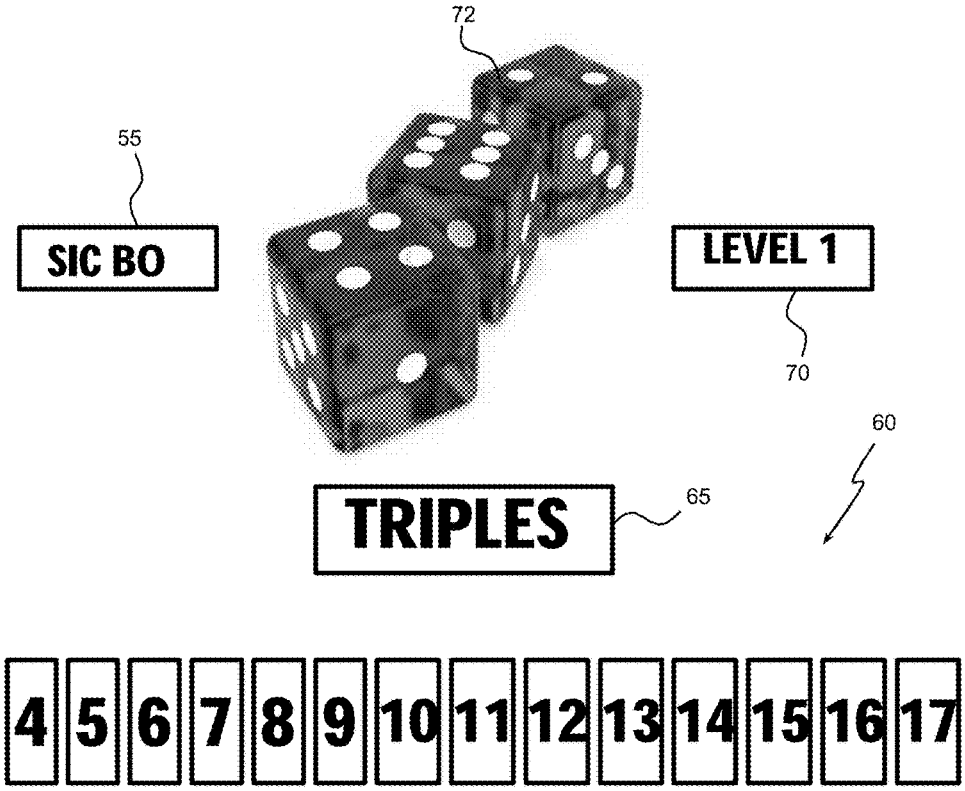

The jackpot feature game 40 commences with the image 50 animating to show the dice being placed into the dice cup, shaken and rolled out one by one, ending with an image 72 showing the result of the dice roll, as best shown in FIG. 7. It will be appreciated that the electronic game controller 4 internally generates the result of each die roll and then selects the appropriate image matching the results of the dice roll to display on the video screen 7. The player may either press of button to activate the animation of the image 50 to commence the roll of each dice or touch image 50 where the video screen 7 is a touch sensitive interface. Alternatively, in another embodiment the roll of each dice in the jackpot feature game 40 may be automatic. Thus, the image 50 animates three times for each die roll activated by the player, who is progressively entertained and excited with each "roll" as the final total is reached to ascertain whether a prize is won or the jackpot game 40 is upgraded or leveled up, as discussed in more detail below.

Figure 8:
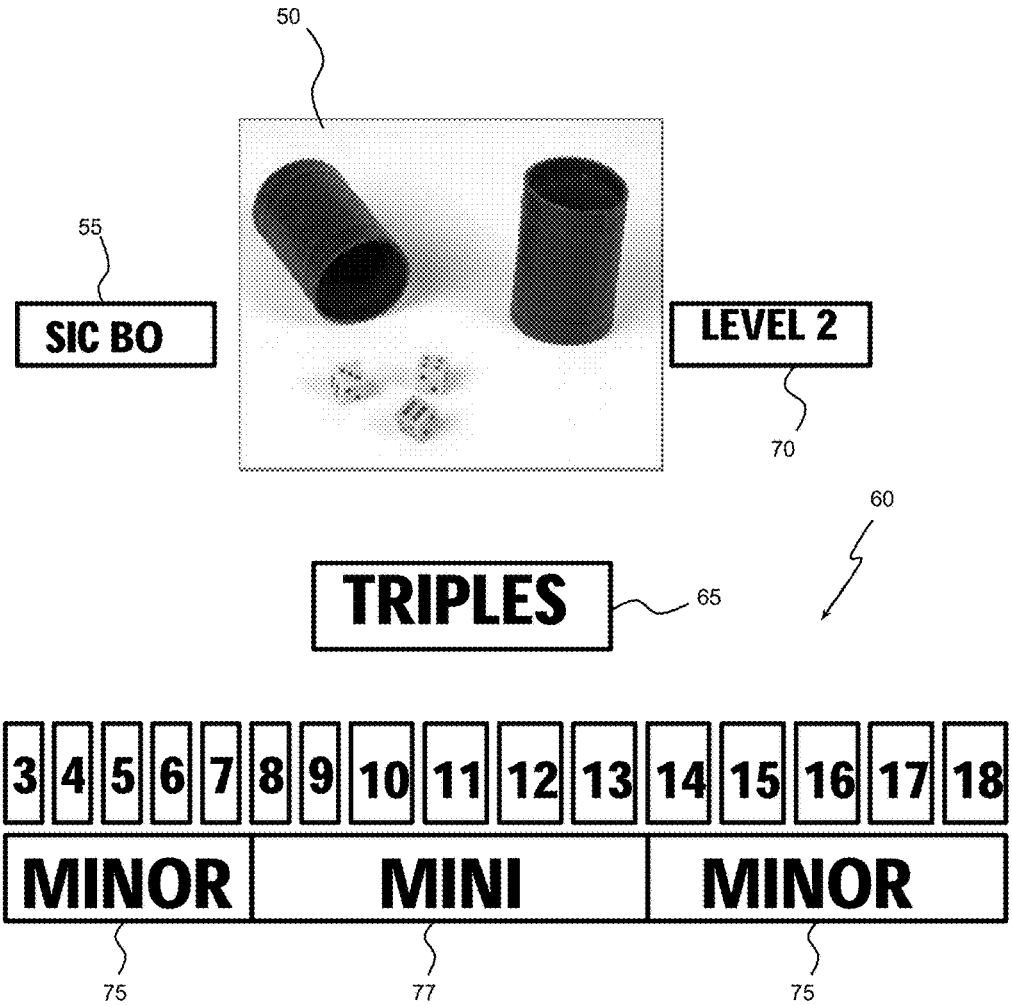
Figure 9:
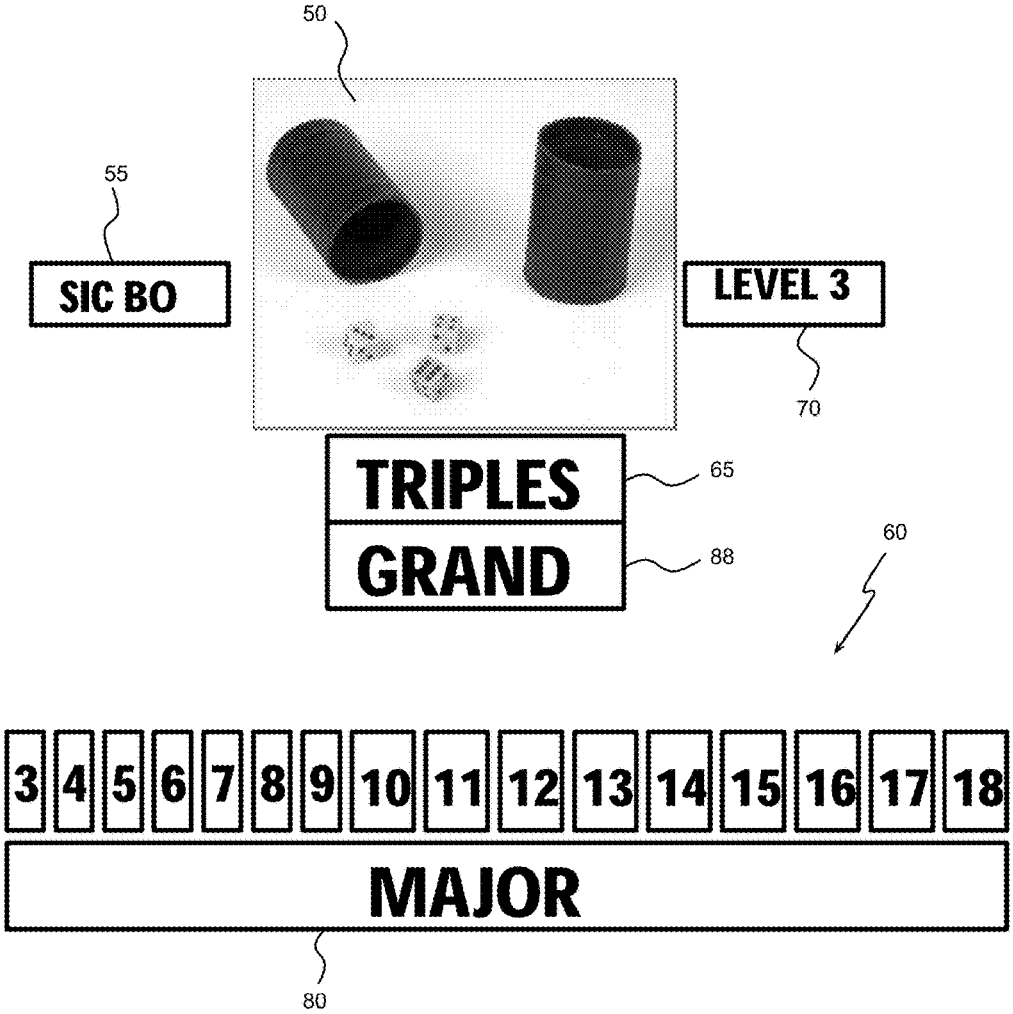

Depending on the numbers rolled on the dice, number corresponding to the total of the rolled dice lights up. Where a triple is rolled, the triple image 65 also lights up. The player is then awarded a prize or receives a "level up" of the jackpot feature game 40. In this embodiment, if the total of the dice is between 9 and 12, then the player is awarded a 1,000 credit prize and the jackpot feature game 40 ends. If the total of the dice is between 4 and 8 or 13 and 17, or a triple is rolled (i.e. three dice showing the same number) then the jackpot feature game 40 levels up to level 2, as best shown in FIG. 8. In FIG. 7, a four, six and two have been rolled, totaling 12. This means that the player receives the 1,000 credit prize. However, if the two on one dice had been a three (bringing the total to 13) or the six on the other dice had been a one (bringing the total to 7), then the jackpot feature game 40 would have upgraded to level 2. Where a player rolls a triple and the total is one which would award the credit prize (i.e. rolling three threes to total 9 or three fours total 12), only the level up is awarded. In other embodiments, both the credit prize and the level up are awarded.

Where the jackpot feature game 40 is upgraded to level 2, the player is able to "roll" the dice again at level 2, as best shown in FIG. 8, where the banner 70 indicates that the jackpot feature game is at level 2. The mat 60 also changes to include the numbers 3 and 18 at either end, but the triples image 65 stays the same. Additional jackpot prize images 75, 77 are shown below the mat 60 corresponding to their respective totals to which they are linked. For example, the MINOR image 75 is placed beneath the number blocks for 3 to 7 and 14 to 18 while the MINI image 77 is placed beneath the number blocks for 8 to 13. Thus, level 2 of the jackpot feature game 40 can be seen as an enhanced version of the game at level 1, with jackpot prizes now provided and the chance for a further level up as discussed below. The electronic game controller 4 again causes the image 50 to animate to show the dice being placed into the dice cup, shaken and rolled out one by one, ending with an image 72 showing the result of the dice roll. If the dice roll has a total that falls within the ranges of 3 to 7 and 14 to 18, the electronic gaming machine 1 will award the player the minor jackpot prize. If the dice roll has a total that falls within the range of 8 to 13, the electronic gaming machine 1 will award the player the mini jackpot prize. If the dice roll results in a triple, then the jackpot feature game 40 levels up or upgrades to level 3. Again, the relevant total of the dice roll will cause the corresponding number block in the mat 60 to light up, but the associated image 75, 77 for the jackpot prizes or image 65 for a triple will also light up. In the case of the triple, the player in this case is also awarded the jackpot prize and the level up. For example, if three fives are rolled, then the player receives the minor jackpot prize for the dice total of 15 (three fives) and still levels up the jackpot feature game 40. Similarly, if three fours are rolled then the player received the mini jackpot prize for the dice total of 12 and still levels up the jackpot feature game 40. Hence, in this embodiment, the player is guaranteed at least a jackpot prize if he or she does not level up or upgrade the jackpot feature game 40 to the next level.

Where the jackpot feature game 40 is upgraded to level 3, the player is able to "roll" the dice again at level 3, as best shown in FIG. 9, with level 3 of the jackpot feature game 40 being indicated by the banner 70. The mat 60 remains the same as in level 2, showing only numbers 4 to 17. The MINOR and MINI images 75, 77 have been replaced with a MAJOR image 80 for awarding a major jackpot prize and a GRAND image 88 has been placed below the triple image 65. Hence, level 2 of the jackpot feature game 40 can be seen as an enhanced version of the game at level 2 or even at level 1, with jackpot prizes of higher worth becoming available. As described above, the electronic game controller 4 again causes the image 50 to animate to show the dice being placed into the dice cup, shaken and rolled out one by one, ending with an image 72 showing the result of the dice roll. In this level, if the dice roll has a total that falls within the ranges of 3 to 18, the electronic gaming machine 1 will award the player the major jackpot prize. If the dice roll results in a triple (i.e. each dice shows the same number—one, two, three, four, five or six), then the electronic gaming machine 1 will also award the player the grand jackpot prize. That is, where a triple is rolled, the player is awarded both the major jackpot and the grand jackpot.

It can be seen that a player in the jackpot feature game 40 can potentially win more than one jackpot prize once he or she reaches level 3, as there is a guarantee of winning the major and/or grand jackpot prize at this level. Thus, the jackpot feature game 40 provides an entertaining method for awarding the player a jackpot or bonus prize as part of a well known and understood gaming mechanic in the form of Sic Bo. Moreover, the jackpot feature game 40 enables greater interaction with the player by permitting in this embodiment for the player to roll each dice individually, simulating a Sic Bo game. Furthermore, the ability to level up or upgrade the jackpot game 40 increases the entertainment to the player as he or she is seeking certain combinations of die rolls (i.e. triples) to access higher value jackpots.

In this embodiment, the minor, mini, major and grand jackpot prizes are all progressive jackpots with starting amounts of $20, $50, $500 and $10,000, respectively. As is generally well known in the art, a progressive jackpot prize takes a portion of each bet (typically a set percentage of each bet) made on the gaming machine and thus the amount of the progressive jackpot incrementally increases as more bets are made on the gaming machine 1. The progressive jackpot is typically awarded when a winning game combination associated with the jackpot occurs in the game played on the gaming machine. In many cases, progressive jackpots are associated with the least probable winning combination and are commonly the highest paying award of the gaming machine. In other cases, a separate trigger event can be used to award the progressive jackpot prize, such as a special jackpot symbol, a trigger event internally generated by the electronic game controller. Alternatively, or additionally, once a certain threshold is met, either a certain amount that has been bet on the gaming machine or the incremented amount of the progressive jackpot, a trigger event is activated in the electronic gaming machine to pay out the progressive jackpot prize. Progressive jackpot prizes also tend to be shared amongst multiple gaming machines so as to increase the amount of the progressive jackpot prize and hence increase player interest in playing one of the electronic gaming machines. In some gaming machines, more than one jackpot or progressive jackpot are offered by the gaming machine or gaming machines linked together.

In some embodiments, the range of numbers associated or linked with the jackpot prizes may vary. For example, in level 2 of the jackpot feature game 40, the mini jackpot prize is awarded for numbers 7 to 14 instead of 8 to 13, thus increasing the probability of winning the mini jackpot that is higher than the minor jackpot. Similarly, in some embodiments, a portion of the dice total range is limited to only awarding one of the available jackpots in level 3 of the jackpot feature game so that some dice totals only award a major jackpot or only award a grand jackpot. For example, dice totals of 9 to 12 may only award the major jackpot while a triple of 3 or 18 may only award the grand jackpot.

In some embodiments, the probability of obtaining the gold die symbols 35 increases as the amount wagered by the player increases. This permits players to determine their own volatility of play of the base game 8 and jackpot feature game 40 by risking a larger amount for a greater award. It will be appreciated that one skilled in the art will recognise that the term "volatility" refers to the expected frequency of winning game events occurring and the corresponding amount paid for each winning game event in order to maintain the required payout level set for the gaming machine. Thus, the amount paid for each winning combination and the level of return to the player determines the "volatility" of the gaming machine. For example, a gaming machine with low volatility is configured to have a relatively high frequency of "wins", where each win has a relatively low value. Conversely, high volatility refers to a lower frequency of "wins" of correspondingly higher value. Throughout the specification, "volatility" is a reference to this characteristic of a gaming machine.

Figure 10:
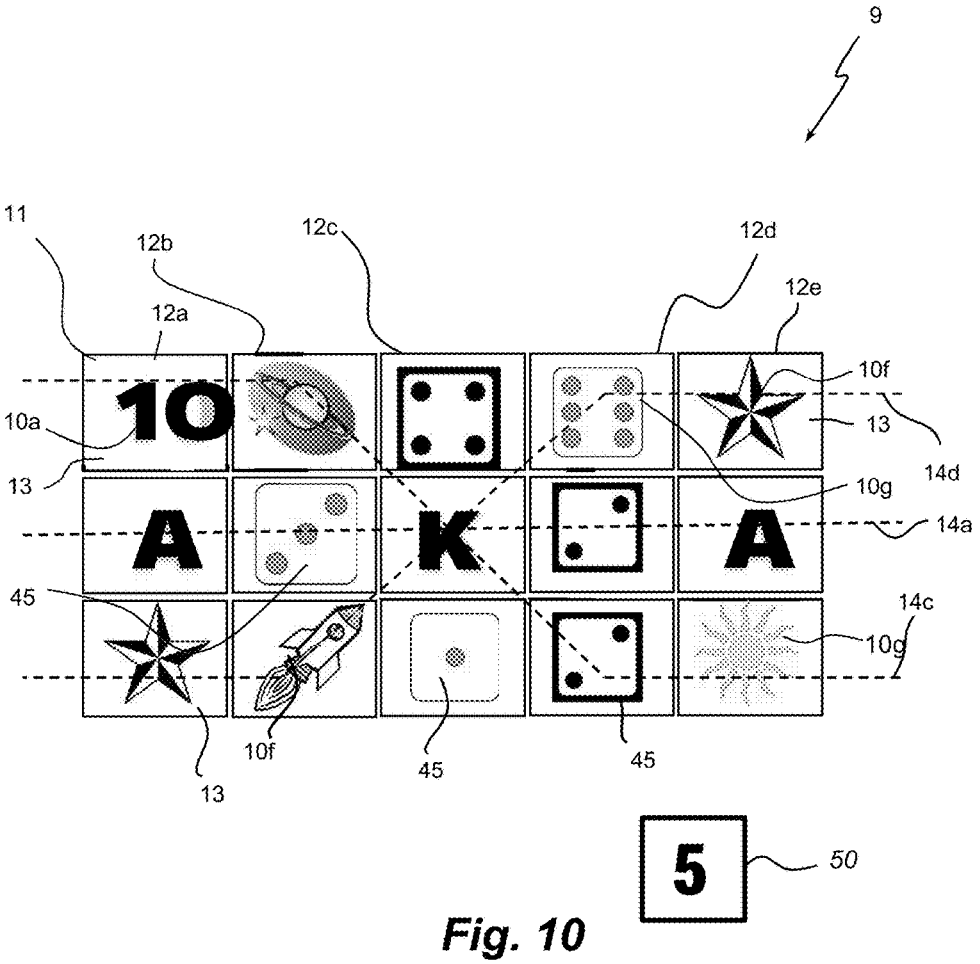
FIG. 10 is a simulated screen shot of another feature game shown on the display of the gaming machine of FIG. 1.

In another embodiment, the jackpot feature game 40 may be triggered or activated from the feature game 9. As best shown in FIG. 10, which shows a spin in the feature game 9 where three gold die symbols 45 have appeared on array 11 in reels 12*b* to 12*d*. Again, winning combinations of game symbols are evaluated on the paylines 14 and prizes awarded that are enhanced by any multipliers conferred by the die symbols 45. For example, on the payline 14*a*, there is a two die symbol 40 and a three gold die symbol 45 and so a multiplier of ×5 (2+3) is applied to the prize awarded for the winning combination appearing on that payline, being a four of a kind of the ace symbol 10*a* formed by two ace symbols one, the two die symbol 40 and the three gold die symbol 45.

On the payline 14*c*, there is only a two die symbol 40 and so a multiplier of ×2 is applied to the prize awarded for the winning combination appearing on that payline. On the payline 14*d*, there is only a gold six die symbol 45 and so a multiplier of ×6 is applied to the prize awarded for the winning combination appearing on that payline, being a three of a kind of the star symbol 10*f* formed by two star symbols and the gold die symbol 45. There is no stacking of multipliers in these two instances as only one die symbol has appeared on each of these paylines. Other multipliers are awarded for paylines on the array, such as the paylines comprising the top and bottom rows of game positions 13 running parallel to payline 14*a*. In case for the payline for the top row a multiplier of ×10 (4+6) is applied and for the payline for the bottom row a multiplier of ×3 (1+2) is applied.

It will also be appreciated that while the described embodiment uses die symbols 45 and a Sic Bo type game mechanic in the jackpot feature game 4, in other embodiments, different symbols and number based games may be used. For example, a bingo or keno type game may be used for each tier of the jackpot game 40, with the die symbols 45 being replaced with numbered ball symbols, the animated image 50 being a ball cage or basket and the mat 60 becoming one or more bingo or keno cards with various combinations of numbers. Completing the card, or a predefined row or column in a card, results in an upgrade or level up of next bingo/keno game.

Figure 11:
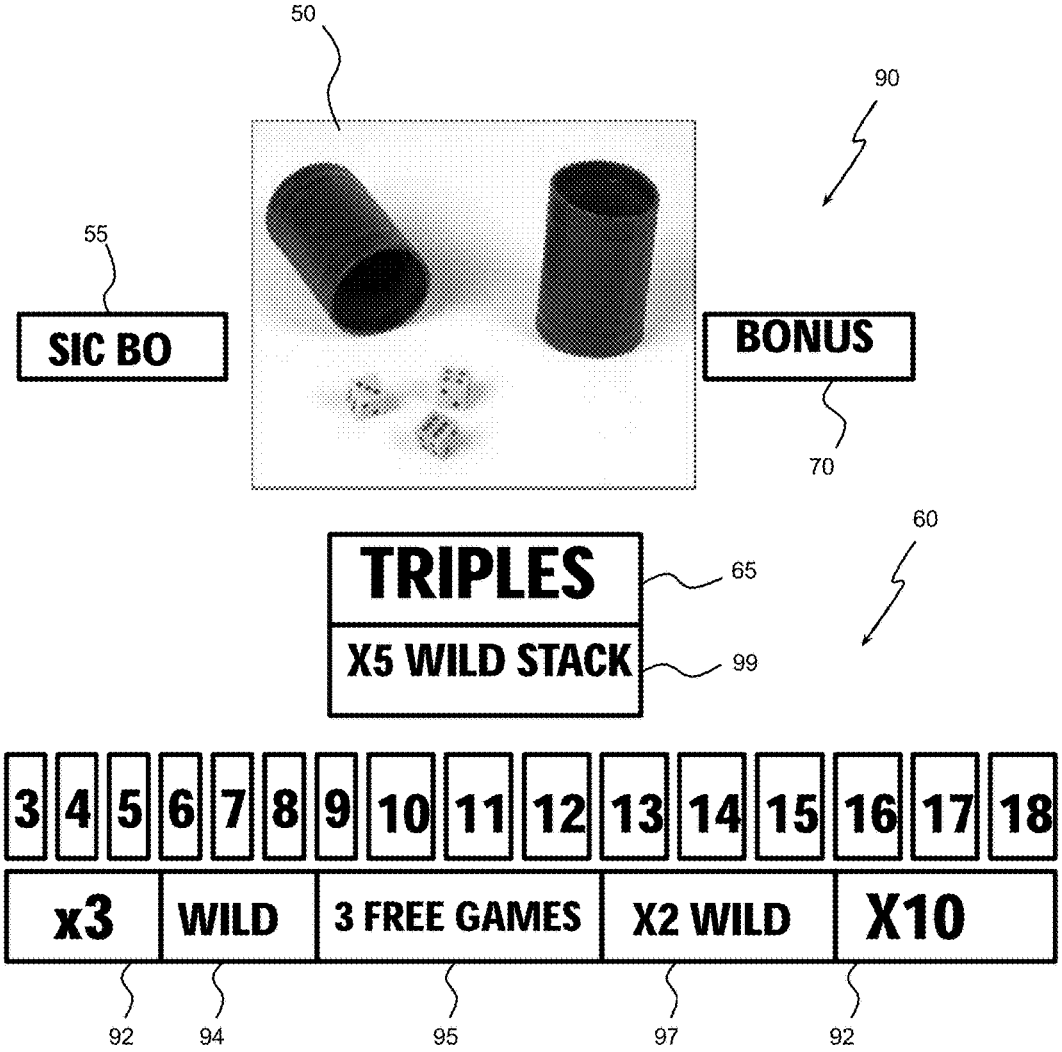
FIG. 11 is a partial simulated screen shot of an intermediate feature game shown on the display of the gaming machine of FIG. 1.

Moreover, in other embodiments, the Sic Bo type game mechanic is used to award different types of game enhancing elements, such as a substitute (wild card) symbol or multiplier, in a subsequently played feature game, such as feature game 9. Referring to FIG. 11, in this alternative embodiment, the trigger for the base game 8 (such as three scatter symbols) causes an intermediate mini game 90 to be played along the same lines as the jackpot feature game 40, where dice "rolls" are used to determine the award of one or more multiplier symbols 92, substitute WILD symbol 94, free games symbols 95 and substitute WILD multiplier symbols 97 associated with different dice totals. The triples image 65 is associated with a special ×5 WILD STACK symbol 99 that awards a stack of ×5 WILD symbols in the feature game. The banner 70 indicates that this mini game 90 is a "bonus" game played prior to playing the feature game.

In further embodiments, each tier or stage of the jackpot feature game 40 comprises a different type of game. For example, the initial stage or tier may comprise a bingo type game, the next stage or tier may comprise a keno type game and the third and final stage or tier may comprise a Sic Bo type game. In yet other embodiments, the jackpot feature game 40 is not limited to three stages or tiers, and there may be multiple stages or tiers in the game as desired, or even only two stages or tiers. For example, where there are four jackpots, the jackpot feature game 40 may have four stages or tiers, with a jackpot being able to be won in each stage or tier.

In addition, the randomly generated numbers need not be displayed as dice. Instead, the randomly generated numbers can be displayed as numbered balls, standalone Arabic numerals, Chinese numerals or any other visual representation of a number. Similarly, the numbers in the mat 60 (or bingo/keno card) may also be similarly represented or displayed on the video screen 7. Similarly, the number of generated random numbers may vary from the three numbers generated in the described embodiment. For example, only two numbers may be randomly generated or multiple numbers may be generated (as in bingo and keno type games).

Hence, the embodiments of the present disclosure enable the gaming machine 1 to award jackpot prizes, especially progressive jackpot prizes, as part of an entertaining interactive jackpot game 40 separate to the base game 8 and the feature game 9. In particular, the jackpot game 40 using a Sic Bo type game mechanic that is both entertaining and easily understood by many players. In addition, the tiered structure of the jackpot game 40 increases the entertainment experience since player become involved (through "throwing" each die as in a Sic Bo game) to upgrade or level up the jackpot game 40 to access higher value jackpots. Thus, the embodiments permit additional prizes of potentially higher worth to be won more frequently in a more entertaining manner to the player.

Figure 12:
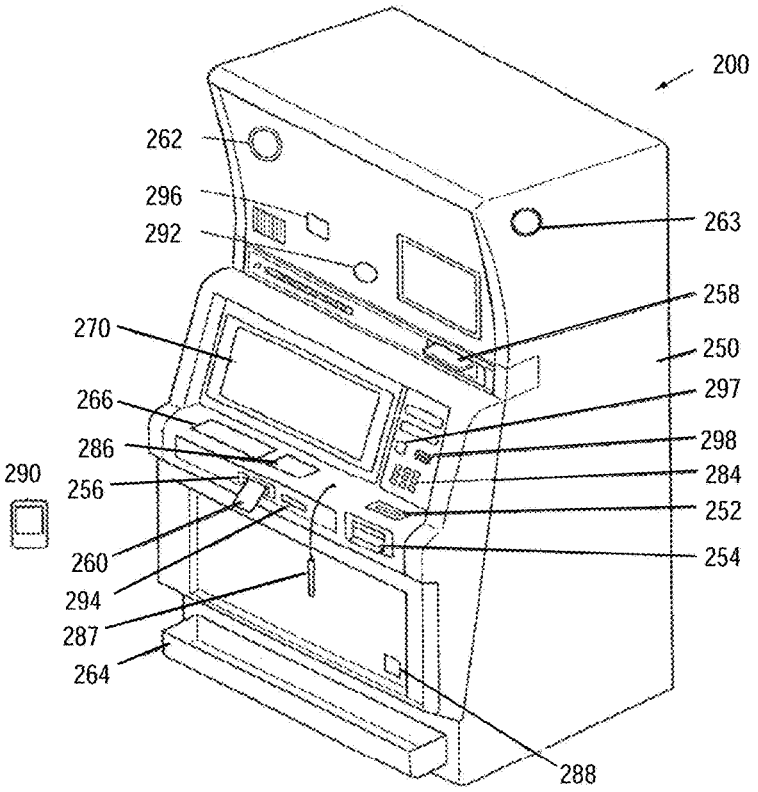
FIG. 12 is a perspective view of an electronic gaming machine according to yet another embodiment of the present disclosure.

Referring to FIG. 12, another embodiment is shown in the form of an electronic gaming machine 200. The electronic gaming machine 200 may include a housing or cabinet 250 and one or more value transfer mechanisms or devices, which may include a coin slot or acceptor 252, a paper currency or bill acceptor 254, a ticket reader/printer 256 and a card reader 258, which may be used to input value to the electronic gaming machine 200. A value transfer device may include any device that can accept value from a player. The topper (not shown) may be mounted to the top of the electronic gaming machine 200.

If provided on the electronic gaming machine 200, the ticket reader/printer 256 may be used to read and/or print or otherwise encode ticket vouchers 260. The ticket vouchers 260 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 260 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 260 could be printed with an optically readable material such as ink, or data on the ticket vouchers 260 could be magnetically encoded. The ticket reader/printer 256 may be provided with the ability to both read and print ticket vouchers 260, or it may be provided with the ability to only read or only print or encode ticket vouchers 260. In the latter case, for example, some of the electronic gaming machines 200 may have ticket printers 256 that may be used to print ticket vouchers 260, which could then be used by a player in other electronic gaming machines 200 that have ticket readers 256.

If provided, the card reader 258 may include any type of card reading device, such as a magnetic card reader or an optical card reader, and may be used to read data from a card offered by a player, such as a credit card or a player tracking card. If provided for player tracking purposes, the card reader 258 may be used to read data from, and/or write data to, player tracking cards that are capable of storing data representing the identity of a player, the identity of a casino, the player's gaming habits, etc.

The electronic gaming machine 200 may include one or more audio speakers 262, a coin payout tray 264, an input control panel 266, and a colour video display unit 270 for displaying images relating to the game or games provided by the electronic gaming machine 200. The audio speakers 262 may generate audio representing sounds such as the noise of spinning reels, a dealer's voice, music, announcements or any other audio related to a game. The input control panel 266 may be provided with a plurality of pushbuttons or touch-sensitive areas that may be pressed by a player to select games, make wagers, make gaming decisions, etc.

Figure 13:
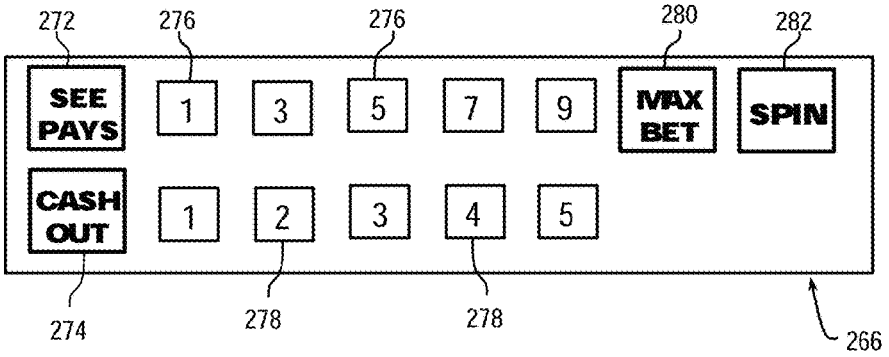
FIG. 13 is a schematic drawing of a control panel for the electronic gaming machine of FIG. 12.

FIG. 13 illustrates one possible embodiment of the control panel 266, which may be used where the electronic gaming machine 200 having a plurality of reels. The control panel 266 may include a "See Pays" button 272 that, when activated, causes the display unit 270 to generate one or more display screens showing the odds or payout information for the game or games provided by the electronic gaming machine 200. As used herein, the term "button" is intended to encompass any device that allows a player to make an input, such as an input device that must be depressed to make an input selection or a display area that a player may simply touch. The control panel 266 may include a "Cash Out" button 274 that may be activated when a player decides to terminate play on the electronic gaming machine 200, in which case the electronic gaming machine 200 may return value to the player, such as by returning a number of coins to the player via the payout tray 264.

The control panel 266 may be provided with a plurality of selection buttons 276, each of which allows the player to select a different number of pay lines prior to spinning the reels. For example, five buttons 276 may be provided, each of which may allow a player to select one, three, five, seven or nine pay lines.

The control panel 266 may also be provided with a plurality of selection buttons 78 each of which allows a player to specify a wager amount for each pay line selected. For example, the electronic gaming machine 200 may be provided with five selection buttons 78, each of which may allow a player to select 1¢, 2¢, 5¢, 10¢ and 20¢, to wager for each pay line selected. In that case, if a player were to activate one of the buttons 276 to select five pay lines and then activate one of the buttons 278 to select 5¢ per pay line to be wagered or bet, the total wager would be $0.25.

The control panel 266 may include a "Max Bet" button 280 to allow a player to make the maximum wager allowable for a game. In the above example, where up to nine pay lines were provided and up to 200 could be wagered for each pay line selected, the maximum wager would be $1.80 The control panel 266 may include a spin button 282 to allow the player to initiate spinning of the reels after a bet has been made.

In FIG. 13, a rectangle is shown around the buttons 272, 274, 276, 278, 280, 282. It should be understood that the rectangle simply designates, for ease of reference, an area in which the buttons 272, 274, 276, 278, 280, 282 may be located. Consequently, the term "control panel" should not be construed to imply that a panel or plate separate from the housing 250 of the electronic gaming machine 200 is required, and the term "control panel" may encompass a plurality or grouping of player activatable buttons.

Although one possible control panel 266 is described above, it should be understood that different buttons could be utilized in the control panel 266, and that the particular buttons used may depend on the game or games that could be played on the electronic gaming machine 200. Although the control panel 266 is shown to be separate from the display unit 270, it should be understood that the control panel 266 could be generated by the display unit 270. In that case, each of the buttons of the control panel 266 could be a coloured area generated by the display unit 270, and some type of mechanism may be associated with the display unit 270 to detect when each of the buttons was touched, such as a touch-sensitive screen.

As noted above, the electronic gaming machine 200 may include a mechanism by which the electronic gaming machine 200 may determine the identity of the player. In particular, the card reader 258 may be used to read a card that carries an identification code that may be uniquely associated with the player so that the gaming unit can differentiate that player from all other players, or so that the gaming unit can differentiate that player as a member of a group of players from all player not a member of the group of players. The electronic gaming machine 200 may also include equipment, such as a keypad 284, an input pad 286 (with optional stylus 287), a port (or antenna) 288 adapted to communicate via a wired or wireless link (infrared or radio frequency link, for example) to a mobile electronic device 290 (such as a personal digital assistant, smart phone or tablet), a camera 292, a scanner 294, a retinal (or iris) scanner 296, fingerprint scanner 297, and/or a microphone 298. The electronic gaming machine 200 may include any one of the devices 258, 284, 286, 288, 290, 292, 294, 296, 297, 298, or the electronic gaming machine 200 may include a combination of some or all of the devices 258, 284, 286, 287, 288, 290, 292, 294, 296, 297, 298.

In operation, a player may identify him or herself to the electronic gaming machine 200 by entering a unique numeric or alpha-numeric code using the key pad 284, for example. Alternatively, the player may use his or her finger or the stylus 287 to sign his or her signature on the input pad 286. As a further alternative, the player may sign his or her signature on the mobile electronic device 290, which signature is then converted to electronic data, and the data is then transferred via the port/antenna 288 to the electronic gaming machine 200. As yet another alternative, the player may sign his or her signature on a piece of paper that is then photographed using the camera 292 or scanned using the scanner 294 (or the bill acceptor 254) to convert the signature into electronic data. As an additional alternative, the player may place one of his or her fingers or his or her hand on the scanner 297, and the scanner 297 may generate an electronic data representation of the fingerprint on one or more of the player's fingers or an electronic data representation of the pattern of the entire hand. Alternatively, the camera 292 may be used to take a picture (live or still) of the player, the picture then being converted into electronic data. As a still further alternative, the player may place his or her eye up to the retinal (or iris) scanner 296, and the retinal (or iris) scanner 296 may generate an electronic data representation corresponding to the pattern of the retina (or iris) of the player. As yet another alternative, the player may speak into the microphone 298, and characteristics of the spoken words (or voiceprint) may be converted into an electronic data representation.

Figure 14:
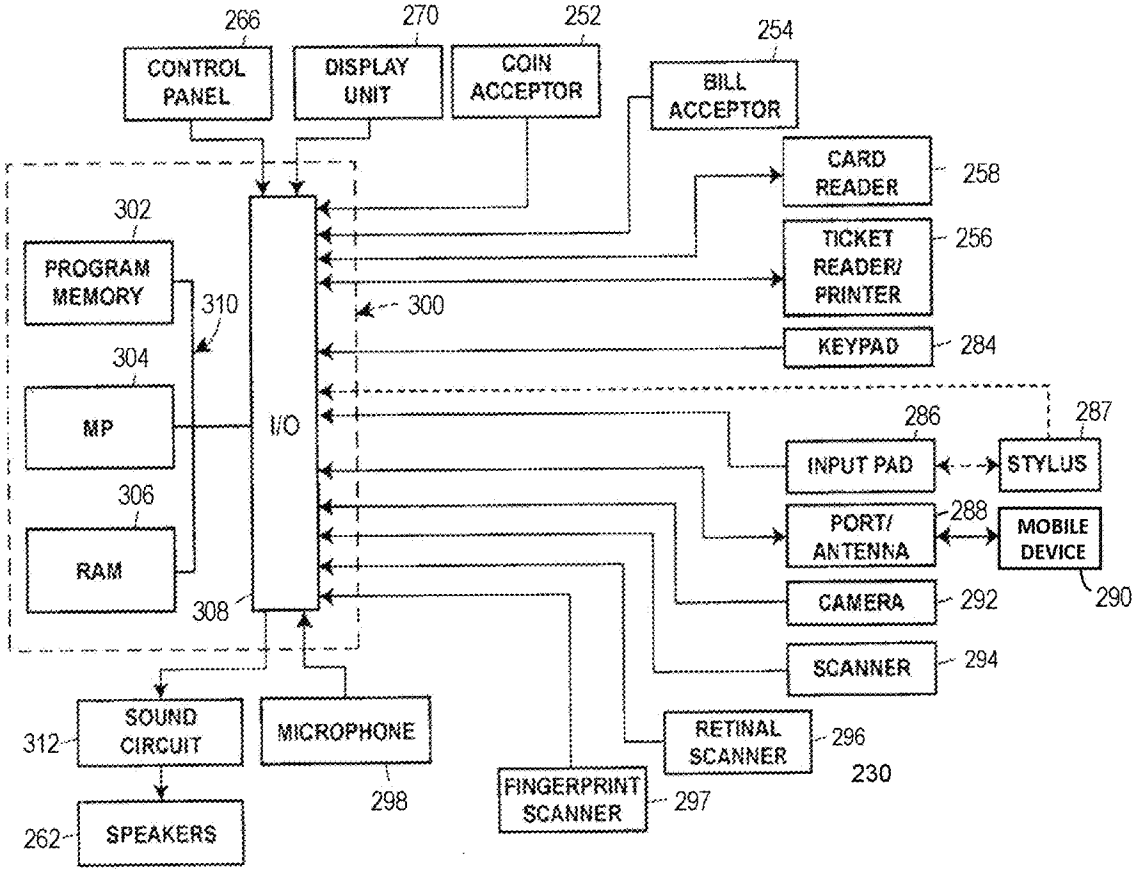
FIG. 14 is a block diagram of the electronic components of the electronic gaming machine of FIG. 12.

FIG. 14 is a block diagram of a number of components that may be incorporated in the electronic gaming machine 200. Referring to FIG. 14, the electronic gaming machine 200 may include a controller 300 that may comprise a program memory 302, a microcontroller or microprocessor (MP) 304, a random-access memory (RAM) 306 and an input/output (I/O) circuit 308, all of which may be interconnected via an address/data bus 310. It should be appreciated that although only one microprocessor 304 is shown, the controller 300 may include multiple microprocessors 304. Similarly, the memory of the controller 300 may include multiple RAMs 306 and multiple program memories 302. Although the I/O circuit 108 is shown as a single block, it should be appreciated that the I/O circuit 308 may include a number of different types of I/O circuits. The RAM(s) 304 and program memories 302 may be implemented as semiconductor memories, magnetically readable memories, and/or optically readable memories, for example.

FIG. 14 illustrates that the coin acceptor 252, the bill acceptor 254, the ticket reader/printer 256, the card reader 258, the control panel 266, the display unit 270, the keypad 284, the input pad 286 (and optionally the stylus 287), the port/antenna 288, the digital camera 292, the scanner 294, the retinal scanner 296, the fingerprint scanner 297 and the microphone 298 may be operatively coupled to the I/O circuit 308, each of those components being so coupled by either a unidirectional or bidirectional, single-line or multiple-line data link, which may depend on the design of the component that is used. The speaker(s) 262 may be operatively coupled to a sound circuit 312, that may comprise a voice- and sound-synthesis circuit or that may comprise a driver circuit. The sound-generating circuit 312 may be coupled to the I/O circuit 308.

As shown in FIG. 14, the components 252, 254, 256, 258, 266, 270, 284, 286, 287, 288, 292, 294, 296, 297, 298, 312 may be connected to the I/O circuit 308 via a respective direct line or conductor. Different connection schemes could be used. For example, one or more of the components shown in FIG. 13 may be connected to the I/O circuit 308 via a common bus or other data link that is shared by a number of components. Furthermore, some of the components may be directly connected to the microprocessor 304 without passing through the I/O circuit 308.

In some embodiments, at least one of the game symbols comprises a game enhancing symbol that confers a game enhancing element to the player. It is further preferred that the game enhancing element modifies the result of a play of the game, which can be any one or combination of the base game 8 and feature game. The game enhancing elements may provide different types of effects or modifications of the game play result. In one embodiment, the game enhancing element comprises the award of one or more plays of the game that do not require a bet from the player. In other words, the game enhancing element awards a predetermined number of "free" games. In some embodiments, the game enhancing element comprises at least one or more a win multiplier, wild multipliers, bonus wilds, symbols that cause the award of additional free games, trigger symbols to retrigger the at least two second arrays, held columns, random wild symbols, stacked symbols, bonus symbols, new game symbols, reveal symbols, progressives, bonus credits, jackpot symbols, and one or more symbol replacements. A variety of game enhancing elements can be awarded by the game enhancing symbols, including:

- symbols that award a predetermined number of free plays of the game;
- win multiplier symbols that multiply the amount of any win from one of the predetermined winning combinations;
- "wild" symbols that cause the display of substitute symbols in randomly selected symbol positions;
- bonus symbols that awards a bonus prize, either as a monetary amount or as a bonus credit;
- wild multiplier symbols that cause the display of substitute symbols on the array 11 and multiplies the amount of any win from one of the predetermined winning combinations;
- bonus wild symbols that cause the display of substitute symbols on the array 11 and awards a bonus prize;
- symbols that cause the award of additional free plays of the game;
- symbols that cause one or more of the symbol positions to be held static (typically one or more reels 12*a* to 12*e*) and display substitute symbols on the array 11;
- symbols that cause the same game symbol to be stacked in a group of symbol positions, typically the group being one or more reels 12*a* to 12*e;*
- symbols that cause the display of new game symbols on the array 11;
- "reveal" symbols that cause a game symbol to reveal another game symbol; and
- "replacement" symbols that cause one or more game symbols to be replaced by other game symbols in the array 11.

These game enhancing symbols do not modify the function or value of the game symbols 10 that appear on the arrays 11, but instead confer bonus prizes, free games or change existing game symbols for other game symbols (such as replacing picture, royal card or symbols belonging to a reel with wild/substitute symbols). Where the function of game symbols 10 have been changed or the game symbols 10 are replaced, then this modification can take effect with the next play of the game instead of applying to the result of the spun array 11. In another embodiment, the game enhancing symbols may indicate the duration in which its game enhancing element is applied, such as a predetermined number of spins or a predetermined time period.

It will be appreciated that in other embodiments, game enhancing elements can also be awarded as a separate aspect of the games 8, 9. The game enhancing elements may further be awarded in addition or as an alternative to the enhanced prizes awarded based on winning combinations of game symbols 10 in the games 8, 9. In a further embodiment, the award of game enhancing elements can be done by way of a sixth reel or the appearance of game enhancing symbols in the reels 12*a* to 12*e*. The sixth reel in this case is simply added as an extension to the array 11 and spins either game enhancing symbols or "blank" symbols.

In some embodiments, the game enhancing symbols include "collector"-type game enhancing symbols which award points or tokens. The collection of points or tokens during the base game 8 and/or feature game 9 leads to the trigger of additional prizes or game enhancing symbols, depending on the number of points or tokens that are collected. These additional prizes can include stand alone progressive jackpots, bonus prizes and super games, which are enhanced versions of free spins or games where there are greater pay outs or frequency of wins.

In other preferred forms, the game enhancing element can be an enhanced version of the array 11. The enhanced array may provide additional game enhancing symbols that include the award of points or an additional number of free spins of the array 11 (for example, retriggering 5 more free spins). The collection of points awarded by the enhanced array during free spins or game leads to the trigger of additional prizes or game enhancing symbols, depending on the number of points that are collected. These additional prizes can include stand alone progressive jackpots, bonus prizes and super games, which are enhanced versions of free spins or games where there are greater pay outs or frequency of wins. In addition, the enhanced array has a different visual representation to the array 11. In addition, the enhanced array may provide game enhancing symbols of greater value and/or frequency compared to the array 11.

Where the game enhancing element comprises the award of a jackpot prize, it can take the form of a standalone progressive jackpot, fixed jackpot, mystery jackpot, symbol driven jackpot and any combination thereof (i.e. a mixture of different types of jackpots). These jackpot prizes are separate to the progressive jackpots awarded in the jackpot feature game 40. In some embodiments, the jackpots are limited to the feature game 9. In other embodiments, the jackpots are shared by the base game 8 and feature game 9. That is, the jackpots could be won through play of the games 8 and 9.

The jackpot or bonus prizes may also be mystery jackpots rather than symbol driven jackpots. That is, none of the symbols in the game trigger the jackpot; hence the trigger event is a "mystery". By way of comparison, a standard jackpot is typically symbol driven in that a particular combination of symbols must occur in the game to trigger the standard jackpot.

The trigger event for the mystery jackpot can be one randomly generated by the electronic game controller 4 for each play of the games 8 and 9. One way to implement the random determination of the trigger event is for the electronic game controller 4 to internally generate a random number and check if it is a predetermined number or within a predetermined range of numbers that will initiate the appearance of the trigger symbols. For example, the predetermined range of numbers could be the range of numbers between 1 and 10 and the electronic game controller 4 internally generates a random number between 1 and 100. If the generated number is any one of numbers 1 to 10, then this results in the electronic game controller 4 causing the trigger event to occur and award the progressive jackpot prize. It will be appreciated that this manner of determining the jackpot trigger event may also be used to determine whether the feature game 9 is triggered in the base game 8.

Progressive jackpots can be confined to the gaming machine 1 as so called "standalone" progressive jackpots.

Alternatively, the jackpot is a wide area or an in-house linked progressive jackpot prize. In other embodiments, one or more the progressive jackpot prizes are configured to be part of a wide area or in-house linked progressive jackpot prize. In other words, the progressive jackpot prizes can be awarded on a group of networked gaming machines in a specified area or a group of specified gaming machines that are linked together for jackpot purposes (usually via a central jackpot controller). The jackpot prizes can also be shared with any other games offered on the same gaming machine 1 (as in multi-game gaming machines).

During play of the games 8 and 9, the electronic game controller 4 will determine whether the trigger event for the jackpot has occurred. In response to the occurrence of the jackpot trigger event(s), the electronic game controller 4 transmits a signal to the video screen 7 to cause the jackpot (s) associated with the jackpot trigger event(s) to be awarded to the player. After the jackpot(s) are awarded, the amounts for any awarded jackpots are reset. The amounts of the jackpots that have been won can be reset either to a predetermined start amount or simply increment upwardly from zero where the won jackpot is a progressive jackpot.

In some embodiments, the in-game trigger event is determined at the end or during the play of the game; i.e. at the end or during a spin of the reels 12. In some embodiments, the in-game trigger event occurs in a preceding play of the game so that the result of the in-game trigger event takes place in a subsequent play of the game, typically the next play of the game after the preceding play but could include a later successive play of the game.

In some embodiments, the frequency of particular game symbols 10 (like substitute game symbols) displayed in the array controlled by choosing different reel strips to display the particular game symbols in the base game 8 and feature game 9. Thus, more game symbols of a particular type (usually associated with higher value prizes) as the bet made by the player increases. This means that the frequency of higher value prizes with their associated game symbols and winning those associated higher value prizes increases. There may also be a combination of frequency of the game symbols of a particular type and using different reel strips for reels with a higher frequency of higher worth game symbols or substitute symbols.

Furthermore, the embodiments of the present disclosure have been described as providing a standard 5×3 array for the base game 8 and the feature game 9. However, it will be appreciated that in other embodiments, the size and shape of the base game array 11 and feature game array may vary as desired. For example, the arrays 11 could take any number of different shapes, such as triangular, circular, square, hexagonal, hemi-spherical or other polygonal shapes. For example, the base game array 11 could comprise a circular array having three rings (equivalent to rows) like a bullseye target segmented into five columns. The feature game array would then expand into additional rings surrounding the initial rings of the base game array 11. Alternatively, the arrays 11 could have an unequal number of rows or columns. For example, the reels 12*a*, 12*b* could have three rows, but the reels 12*c* to 12*e* could have four rows.

In a further variation to the embodiments, each game or symbol position 13 comprises its own individual reel and three of the reels may be grouped into columns of reels. That is, each symbol position 13 has its own individual reel strip of game symbols.

In other embodiments, the gaming machine 1 also offers the player the opportunity to play in community games against other players in so-called tournament games, or even in player versus player games. This is typically implemented by electronically linking several gaming machines 1 in a group within a gaming venue. The player versus player or tournament game can be played simultaneously by the players or can be staggered, with some players playing at one time and some players playing at another time in the same game. In this situation, the player versus player or tournament game comprises the award of an additional bonus prize in addition to the jackpot prizes in the selected available jackpot set.

While the same game format is essentially used across the base game 8 and feature game 9, it will be appreciated that the game format may vary across the base and feature games, as well as between base games where more than one game is offered by the same electronic gaming machine 1. For example, one of the games 8 may be a wheel-type game or a four reel game and another of the games may be a standard five reel game. Similarly, the games 8 may each have different game symbols, game rules and pay tables that are unique to each game.

While one embodiment has been described in relation to a base game 8 and a feature game 9, it will be appreciated that the present disclosure could include one or more additional feature games that are triggered by specific trigger symbols appearing in the feature game 9. Also, the additional feature games may also have trigger symbols that trigger further feature games in a cascading fashion. These additional and further feature games could have the same game play elements as the feature game 9 or be different feature games entirely.

In other embodiments, the base game 8 and the feature game 9 need not be displayed alternately on a single video screen 7. Instead, they may be displayed on the same video screen 7, with the base game 8 shown in the lower playing area 7*a* and the feature game 9 shown in the upper display area of the video screen 7. Alternatively, the base game 8 and the feature game 9 are shown on separate video screens, with the base game 8 shown in a lower video screen corresponding to the lower playing area 7*a* and the feature game 9 shown in an upper video screen corresponding to the upper display area. Also, the order can be reversed, with the lower playing area 7*a* or video screen showing the feature game 9 and the upper video screen or upper playing area of a single video display screen 7 showing the base game 8.

In another embodiment, the video screen 7 is a touch screen for use in addition to the player-actuatable buttons 6 so as to enable the player to select the bet level (such as bet denominations or bet per pay line 14) as well as other various features, such as making monetary bets for the game, initiating play of any base and feature games played and responding to any messages or requests issued on the gaming machine 1 by the electronic game controller 4. In this case, the player may control when the reels 12 start spinning and stop spinning, either individually or collectively, by simply touching the reels 12. Control over spinning of the reels 12 can also be implemented through the buttons 6 on the console 3. This increases player interaction and provide the player with an opportunity to guess when a particular game symbol 10 may appear in the reels 12.

In some embodiments, in response to a feature game trigger event in the base game, the electronic controller causes the display to display game symbols for playing the feature game. Alternatively, the electronic controller causes the display of the feature game and the base game during play of the base game, the feature game being inactive until triggered. In this embodiment, the change in the feature game from being inactive to active may be indicated on the display. This indication may be visual, aural or a combination of both.

In some embodiments, the gaming machine comprises an input device for receiving commands from the player to play the game, wherein the input device comprises one or more buttons in electronic communication with the electronic controller to transmit the player commands to the electronic controller.

In some embodiments, the input device comprises one or more buttons on the housing, the buttons being in electronic communication with the electronic controller. In other embodiments, the buttons are arranged on a console of the housing. Alternatively or additionally, the input device comprises a touch sensitive surface on the display for receiving commands from the player, the touch sensitive surface being in electronic communication with the electronic game controller to transmit the player commands to the electronic controller.

In some embodiments, the gaming machine comprises a value transfer mechanism for receiving value from the player to make a bet and initiate a play of the game. In other embodiments, the value transfer mechanism also pays the prizes to the player using value in an amount equal to an awarded prize. It is further preferred that the housing comprises the value transfer mechanism. In one embodiment, the value transfer mechanism comprises one or more vending slots for paying and/or receiving value. In other embodiments, the value transfer mechanism comprises a value input/value output device. In further embodiments, the value transfer mechanism comprises a coin slot or acceptor, a paper currency acceptor, a ticket reader and/or printer or a card reader and/or writer.

In some embodiments, the game enhancing element comprises at least one or more of a predetermined number of free games, a win multiplier, wild multipliers, bonus wilds, symbols that cause the award of additional free games, trigger symbols to retrigger the at least two second arrays, held columns, random wild symbols, stacked symbols, bonus symbols, new game symbols, reveal symbols, progressives, bonus credits, jackpot symbols, and one or more symbol replacements.

In some embodiments, the base game and the feature game each comprises an array of rows and columns of the predetermined game positions, and the base game array is different in size and/or dimensions to the feature game array. In other embodiments, the feature game array is greater in size than the base game array. In one preferred form, the base array comprises three rows and five columns and the feature game array comprises either more than three rows or more than five columns. In a further preferred form, the feature game array is an extended base game array.

In some embodiments, a feature game trigger event occurs in the base game to trigger the feature game. In one embodiment, the feature game trigger event comprises a random event determined by the electronic game controller at the start of play of the feature game. In another embodiment, the feature game trigger event comprises the appearance of at least one trigger symbol in the base game array. In another alternative, the feature game trigger event comprises an in-game event during play of the base game.

In some embodiments, the array (including the base game array and/or the feature game array) take any one of a circular, triangular, oval, semi-circular, hexagonal, pentagonal, octagonal, non-rectangular or polygonal shape. In one preferred form, the wheels and the enhanced wheels arrays take the form of partially shown circular wheels.

In some embodiments, the player selectively starts and/or stops play of the base game array and/or the feature game array.

In some embodiments, the gaming machine comprises a mobile electronic gaming device. In other embodiments, the mobile electronic gaming device comprises a handheld electronic device. In one preferred form, the handheld electronic device comprises a handheld electronic gaming device or a smart phone. Alternatively, the gaming machine comprises a computer. In other embodiments, the computer is connected to a communication network.

It will be appreciated that while the preferred embodiments have been described in relation to an industry standard electronic gaming machine, the present disclosure can be readily applied to other types of electronic gaming machines, including a personal computer (standing alone or connected to a communications network, LAN or WAN), mobile electronic devices (such as handheld or portable electronic devices like tablets and smart phones) and other electronic devices capable of displaying a game. In the case of mobile electronic device, in one arrangement it may permit the player to make bets using "virtual" credits that represent a monetary value, but do not require the player to make a monetary transaction. Instead, the present disclosure may provide a tiered access to the various features of the game so that the player can make relatively small payments to access particular features of the game or obtain additional benefits during game play. An alternative arrangement would require the player to purchase virtual credits or tokens via an interface on the mobile electronic device or an online interface accessible by the mobile electronic device. Similarly, either of the above described arrangements can be applied where the present disclosure is implemented on a personal computer (PC) connected to the internet (wirelessly or not). In one example of the implementation, the PC would access an online casino over the internet to play the game of the present disclosure or the game of the present disclosure would be part of a social networking website. It is also contemplated that the player could also make regular payments to subscribe to continue playing the game on the mobile electronic device, PC or other electronic device.

In an alternative embodiment, the gaming machine also provides an option for the player to play with either credits based on a monetary amount or virtual credits as discussed above. This can be implemented by way of a selection menu prior to playing the selected game or by providing a suitable menu button on screen during play of the selected game.

In another aspect, the present disclosure includes a computer programme configured to perform the present disclosure. In this way the present disclosure can be implemented in various ways on a gaming machine. In a further aspect, the present disclosure includes a gaming system configured comprising a central processing unit (such as a computer or computational processor) configured for communication with a gaming machine to perform the present disclosure. In a yet another aspect, the present disclosure includes a non-transitory computer readable or carrier medium carrying computer executable code that, when executed on a central processing unit configured for communication with a gaming machine, causes the central processing unit to perform the present disclosure. In this case, the non-transitory carrier medium includes an external hard drive, a memory device, including a memory card, smart card, a radio frequency identification (RFID) device, USB key, magnetic card or other electronic storage device.

While the illustrated embodiments include an electronic display on which the array of game positions is displayed, it will be recognized that the disclosed embodiments could instead incorporate mechanical or electro-mechanical reels to define the array of game positions. In fact, to the extent that the game positions, game symbols or operation of the gaming machine described herein would require a modification of such mechanical or electro-mechanical reels, it will be recognized that the embodiment represents a change in the structure or operation of a machine, rather than simply a variation in the rules of playing a game. In addition or in the alternative, the variation in the game positions, game symbols or operation of the gaming machine described herein may be viewed as analogous to a method for utilizing a new game apparatus (like a new deck of cards), rather than simply as a new set of rules in and of themselves.

It will further be appreciated that any of the features in the preferred embodiments of the present disclosure can be combined together and are not necessarily applied in isolation from each other. For example, the feature of the player being able to selectively starting or stopping spinning of the reels 12 and the feature of providing separate video screens for the lower playing area 7*a* and upper display area can be combined into a single gaming machine 1. Similar combinations of two or more features from the above described embodiments or embodiments of the present disclosure can be readily made by one skilled in the art.

By providing at least two games comprising randomly generated numbers, where a combination in one game triggers the other game and a combination in the other game confers a jackpot to the player, the embodiments of the present disclosure increase player interaction and provide an entertaining and exciting set of games in which a jackpot prize may be won. The embodiments of the present disclosure also add greater entertainment to a player in terms of providing greater variety in game play, especially compared to a conventional gaming machine that only has one set of reels and a single feature game. All these advantages of the present disclosure result in the player being more likely to retain interest in continuing to play the same gaming machine due to the variation in game play on the gaming machine. Furthermore, since the electronic controller controls operation of the gaming machine, the present disclosure can be readily implemented to existing gaming machines, including EGMs, electro-mechanical or purely mechanical gaming machines as well as other gaming systems. In all these respects, the present disclosure represents a practical and commercially significant improvement over the prior art.

In conclusion, although the preceding text sets forth a detailed description of different embodiments of the present disclosure, it should be understood that the legal scope of the present disclosure is defined by the words of the claims set forth at the end of this patent. The detailed description is to be construed as exemplary only and does not describe every possible embodiment of the present disclosure since describing every possible embodiment would be impractical, if not impossible. Numerous alternative embodiments could be implemented, using either current technology or technology developed after the filing date of this patent, which would still fall within the scope of the claims defining the present disclosure.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

The invention claimed is:

1. A gaming machine comprising:

a display; and an electronic controller coupled to a display, the electronic controller being configured to:

display a first game on the display including a plurality of randomly generated game symbols, wherein a first combination of two or more of the randomly generated game symbols is associated with triggering a first level of a Sic Bo type game;

display the first level including a plurality of randomly generated numbers each corresponding to one of a plurality of displayed dice, wherein at least one combination of three or more of the randomly generated numbers is associated with a value award payable to a player and at least one combination of three or more randomly generated numbers is associated with triggering a second level of the Sic Bo type game, the at least one combination of three or more randomly generated numbers associated with triggering the second level including a combination of three or more randomly generated numbers that are at least three of a kind;

display the second level including a plurality of randomly generated numbers each corresponding to one of a plurality of displayed dice, wherein at least one combination of three or more of the randomly generated numbers is associated with a progressive jackpot prize and at least one combination of three or more randomly generated numbers is associated with triggering a third level of the Sic Bo type game, the at least one combination of three or more randomly generated numbers associated with triggering the third level including a combination of three or more randomly generated numbers that are at least three of a kind.

2. The gaming machine of claim 1, wherein more than one combination of two or more of the randomly generated game symbols in the first game is associated with triggering the first level of the Sic Bo type game.

3. The gaming machine of claim 1, wherein the first level of the Sic Bo type game comprises a plurality of value awards, the value awards having differing amounts of value, and each of the at least one combinations of three or more of the randomly generated numbers associated with a value award being associated with at least one value award of the plurality of value awards.

4. The gaming machine of claim 1, wherein the first level of the Sic Bo type game comprises a plurality of value awards, the value awards having differing amounts of value, and each value award is associated with each of the at least one combination of three or more of the randomly generated numbers associated with a value award.

5. The gaming machine of claim 1, wherein the first level comprises a plurality of value awards and the at least one combination of three or more randomly generated numbers associated with triggering the second level is associated with at least one of the value awards.

6. The gaming machine of claim 1, wherein the first game comprises one or more combinations of two or more of the randomly generated game symbols associated with a value award payable to a player.

7. The gaming machine of claim 6, wherein the value award of the first game comprises a progressive jackpot prize.

8. The gaming machine of claim 1, wherein the first game comprises two or more plays of the first game and each play of the first game comprises generating one of the first plurality of randomly generated game symbols.

9. The gaming machine of claim 8, wherein each play of the first game requires a wager.

10. The gaming machine of claim 1, wherein the second level comprises a plurality of progressive jackpot prizes, the progressive jackpot prizes having differing amounts of value, and each of the at least one combination of three or more of the randomly generated numbers associated with a progressive jackpot prize being associated with at least one progressive jackpot prize of the plurality of progressive jackpot prizes.

11. The gaming machine of claim 1, wherein the second level comprises a plurality of progressive jackpot prizes, the progressive jackpot prizes having differing amounts of value, and each progressive jackpot prize is associated with each of the at least one combination of three or more of the randomly generated numbers associated with a progressive jackpot prizes.

12. The gaming machine of claim 1, wherein the second level comprises a plurality of progressive jackpot prizes and the at least one combination of three or more randomly generated numbers associated with triggering a third level is associated with at least one of the progressive jackpot prizes.

13. The gaming machine of claim 1, wherein each play of the first level does not require a wager.

14. The gaming machine of claim 1, wherein each play of the second and third levels does not require a wager.

15. The gaming machine of claim 1, the electronic controller being configured to display the third level including a plurality of randomly generated numbers each corresponding to one of a plurality of displayed dice, wherein each combination of three or more of the randomly generated numbers is associated with at least one progressive jackpot prize.

* * * * *